US011670231B2

(12) United States Patent
Ok et al.

(10) Patent No.: US 11,670,231 B2
(45) Date of Patent: Jun. 6, 2023

(54) DISPLAY DRIVING CIRCUIT AND A DISPLAY DEVICE INCLUDING THE SAME

(71) Applicant: SAMSUNG ELECTRONICS CO., LTD., Suwon-si (KR)

(72) Inventors: Jiheon Ok, Suwon-si (KR); Yoonho Ko, Suwon-si (KR); Taekon Yu, Suwon-si (KR); Hwahyun Cho, Suwon-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 0 days.

(21) Appl. No.: 17/570,926

(22) Filed: Jan. 7, 2022

(65) Prior Publication Data

US 2022/0130332 A1 Apr. 28, 2022

Related U.S. Application Data

(62) Division of application No. 16/816,805, filed on Mar. 12, 2020, now Pat. No. 11,244,612.

(30) Foreign Application Priority Data

May 22, 2019 (KR) ..... 10-2019-0060224

(51) Int. Cl.
*G09G 3/3233* (2016.01)

(52) U.S. Cl.
CPC ..... *G09G 3/3233* (2013.01); *G09G 2320/029* (2013.01); *G09G 2320/0233* (2013.01); *G09G 2320/0276* (2013.01); *G09G 2320/041* (2013.01); *G09G 2320/045* (2013.01); *G09G 2320/048* (2013.01)

(58) Field of Classification Search
None
See application file for complete search history.

(56) References Cited

U.S. PATENT DOCUMENTS 9,805,646 B2 10/2017 Park
9,818,373 B2 11/2017 Ohta et al.
9,940,871 B2 4/2018 Lee
(Continued)

FOREIGN PATENT DOCUMENTS

KR 10-2016-0055559 5/2016
KR 10-2016-0063449 6/2016
(Continued)

*Primary Examiner* — Parul H Gupta
(74) *Attorney, Agent, or Firm* — F. Chau & Associates, LLC

(57) ABSTRACT

A display driving circuit including: a data driver configured to supply driving signals to a plurality of pixels of a display panel and sense electrical characteristics of each of the plurality of pixels; and a degradation compensation circuit configured to generate and store an accumulated degradation value by, accumulating degradation values for each of a plurality of pixel blocks for a unit time, based on driving data corresponding to the driving signals, correct the accumulated degradation value of a first pixel block, based on sensing data received from the data driver, and perform data compensation to compensate for pixel degradation, based on the accumulated degradation values and a degradation model, wherein each pixel block includes at least one pixel.

19 Claims, 19 Drawing Sheets

(56) References Cited

U.S. PATENT DOCUMENTS

| | | | | |
|---|---|---|---|---|
| 10,297,193 | B2 | 5/2019 | Hwang et al. | |
| 10,311,778 | B2 | 6/2019 | Lee | |
| 2005/0248517 | A1 | 11/2005 | Luther Weindorf | |
| 2010/0066878 | A1 | 3/2010 | Mabuchi | |
| 2011/0057571 | A1* | 3/2011 | Ackermann | H05B 45/59 315/158 |
| 2014/0176409 | A1* | 6/2014 | Kim | G09G 3/3233 345/92 |
| 2015/0373291 | A1 | 12/2015 | Oh et al. | |
| 2016/0171934 | A1 | 6/2016 | Yang et al. | |
| 2016/0191952 | A1* | 6/2016 | Kim | G09G 3/3233 375/240.27 |
| 2017/0061897 | A1 | 3/2017 | Zhang et al. | |
| 2017/0067957 | A1 | 3/2017 | Lee | |
| 2017/0076660 | A1 | 3/2017 | Lee | |
| 2018/0020525 | A1 | 1/2018 | Moon et al. | |
| 2018/0151112 | A1 | 5/2018 | Song et al. | |
| 2018/0151119 | A1 | 5/2018 | Lee et al. | |
| 2020/0372861 | A1 | 11/2020 | Ok et al. | |

FOREIGN PATENT DOCUMENTS

| | | |
|---|---|---|
| KR | 10-2017-0003213 | 1/2017 |
| KR | 10-2017-0030113 | 3/2017 |
| KR | 10-2017-0032509 | 3/2017 |
| KR | 10-2018-0009407 | 1/2018 |
| KR | 10-2018-0059604 | 6/2018 |

* cited by examiner

| PX | CDT | DV | ADV(N-1) | ADV(N) |
|---|---|---|---|---|
| PXB1 | 255G | 1 | 0.5 | 1.5 |
| PXB2 | 127G | 0.5 | 0.5 | 1 |

(Nth Frame)

| PX | CDT | DV | ADV(N) | ADV(N+1) |
|---|---|---|---|---|
| PXB1 | 255G | 1 | 1.5 | 2.5 |
| PXB2 | 63G | 0.25 | 1 | 1.25 |

(N+1th Frame)

DISPLAY DRIVING CIRCUIT AND A DISPLAY DEVICE INCLUDING THE SAME

CROSS-REFERENCE TO RELATED APPLICATIONS

This application is a divisional of U.S. patent application Ser. No. 16/816,805 filed on Mar. 12, 2020, which claims priority under 35 U.S.C. § 119 to Korean Patent Application No. 10-2019-00602241, filed on May 22, 2019, in the Korean Intellectual Property Office, the disclosures of are incorporated by reference wherein in their entireties.

TECHNICAL FIELD

The inventive concept relates to a semiconductor device, and more particularly, to a display driving circuit for driving a display panel to display an image, and a display device including the same.

DISCUSSION OF RELATED ART

In general, a display device includes a display panel for displaying an image and a display driving circuit for driving the display panel. The display driving circuit may drive the display panel by receiving image data and applying an image signal corresponding to the image data to a data line of the display panel. Recently, the use of organic light-emitting diode ("OLED") display panels is increasing. In an OLED display panel, each of a plurality of pixels of a pixel array includes an OLED. In an OLED display panel, when electrical characteristics, such as a threshold voltage and current mobility, of a driving transistor included in each pixel are degraded, image quality of the OLED display decreases. To prevent pixels from degrading, a degradation model method or a characteristic sensing method may be used. In the degradation model method, a degree of degradation is estimated by using degradation values accumulated based on input data and through degradation modeling, and the input data is compensated, based on the estimated degree of degradation. In the characteristic sensing method, a degree of degradation is calculated, based on the electrical characteristics, and input data is compensated, based on the degree of degradation.

SUMMARY

According to an exemplary embodiment of the inventive concept, a display driving circuit includes a data driver configured to supply driving signals to a plurality of pixels of a display panel and sense electrical characteristics of each of the plurality of pixels; and a degradation compensation circuit configured to generate and store an accumulated degradation value by accumulating degradation values for each of a plurality of pixel blocks for a unit time, based on driving data corresponding to the driving signals, correct the accumulated degradation value of a first pixel block, based on sensing data received from the data driver, and perform data compensation to compensate for pixel degradation, based on the accumulated degradation values and a degradation model, wherein each pixel block includes at least one pixel.

According to another exemplary embodiment of the inventive concept, a display device includes a display panel including a plurality of pixels divided into a plurality of pixel blocks; a data driver configured to supply a driving signal to each of the plurality of pixels and sense electrical characteristics of each of the plurality of pixels; and a degradation compensation circuit configured to compensate input data corresponding to each of the plurality of pixels, based on a compensation rate of the pixels corresponding to the input data, and provide the compensated input data to the data driver, wherein the degradation compensation circuit is further configured to generate and accumulate a degradation value for each of the plurality of pixels, based on driving data corresponding to the driving signal supplied to each of the plurality of pixels, calculate a compensation rate for each of the plurality of pixels by using each pixel's accumulated degradation value and a degradation model, and correct the accumulated degradation value for each of the plurality of pixels, based on the sensed electrical characteristics.

According to another exemplary embodiment of the inventive concept, an operation method of a display driving circuit for driving a display panel with a plurality of pixel blocks includes generating a plurality of accumulated degradation values by calculating and accumulating a degradation value of each of the plurality of pixel blocks, based on driving data supplied to each of the plurality of pixel blocks, wherein each of the plurality of pixel blocks includes at least, one pixel; determining at least one pixel block as a sensing pixel block, based on the plurality of accumulated degradation values; sensing electrical characteristics of the sensing pixel block; correcting the accumulated degradation value corresponding to the sensing pixel block to match a degradation rate, based on sensing data; and performing degradation compensation on the plurality of pixel blocks, based on the plurality of accumulated degradation values.

According to another exemplary embodiment of the inventive concept, a display driving circuit includes: a data driver configured to supply driving signals to a plurality of pixels of a display panel and sense electrical characteristics of each of the plurality of pixels; and a degradation compensation circuit configured to store a plurality of accumulated degradation values of a first frame in a memory, each of the accumulated degradation values corresponding to a respective one of a plurality of pixel blocks, determine a sensing pixel black of the plurality of pixel blocks based on the plurality of accumulated degradation values, and correct the accumulated degradation value corresponding to the sensing pixel block based on sensing data obtained from the sensing pixel block.

BRIEF DESCRIPTION OF THE DRAWINGS

The above and other features of the inventive concept will be more clearly understood by describing in detail exemplary embodiments thereof in conjunction with the accompanying drawings in which.

DETAILED DESCRIPTION OF THE EMBODIMENTS

Hereinafter, exemplary embodiments of the inventive concept are described in connection with the accompanying drawings.

Figure 1:
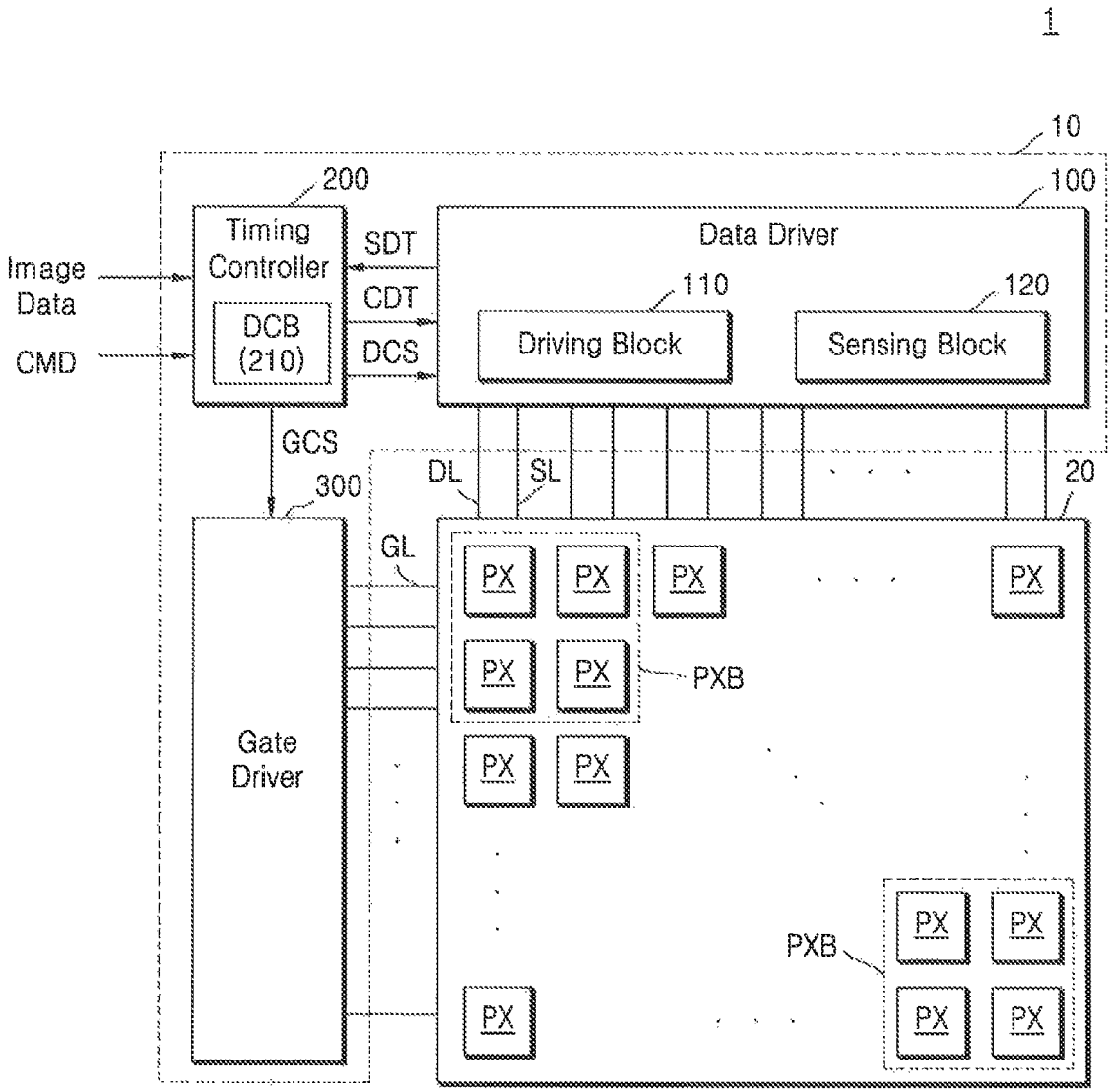
FIG. 1 is a block diagram of a display device according to an exemplary embodiment of the inventive concept.

FIG. 1 is a block diagram of a display device according to an exemplary embodiment of the inventive concept.

A display device 1 according to an exemplary embodiment of the inventive concept may be provided in an electronic device having an image display function. Examples of the electronic device may include a smartphone, a tablet personal computer (PC), a portable multimedia player (PMP), a camera, a wearable device, a television, a digital video disk (DVD) player, a refrigerator, an air conditioner, an air cleaner, a set-top box, a robot, a drone, various types of medical devices, a navigation device, a global positioning system (GPS) receiver, an advanced driverless assistance system (ADAS), an on-vehicle device, furniture, various measuring instruments, etc.

Referring to FIG. 1, the display device 1 may include a display driving circuit 10 and a display panel 20, and the display driving circuit 10 may include a timing controller 200, a data driver 100, and a gate driver 300. In an exemplary embodiment of the inventive concept, the display driving circuit 10 and the display panel 20 may be embodied as one module. For example, the display driving circuit 10 may be mounted on a circuit film, such as a tape carrier package (TCP), a chip-on-film (COF), or a flexible printed circuit (FPC), and then, be mounted on the display panel 20 by a tape automatic bonding (TAB) method or mounted on a non-display area of the display panel 20 by a chip-on-glass (COG) method.

The display panel 20 may include a plurality of signal lines, e.g., a plurality of gate lines GL, a plurality of data lines DL and a plurality of sensing lines SL, and a plurality of pixels PX, e.g., a pixel array, arranged in a matrix.

Each of the plurality of pixels PX may display a color among red, green, and blue, and a pixel displaying red, a pixel displaying green, and a pixel displaying blue may be repeatedly arranged in order. A user may recognize light of a color which is a mixture of red light, green light, and blue light displayed by adjacent pixels PX. In an exemplary embodiment of the inventive concept, a pixel displaying red, a pixel displaying green, and a pixel displaying blue may be respectively referred to as a red sub-pixel, a green sub-pixel, and a blue sub-pixel, and a group of the red sub-pixel, the green sub-pixel, and the blue sub-pixel may be referred to as a pixel. In an exemplary embodiment of the inventive concept, each of the plurality of pixels PX may display one of red, green, blue, and white. However, the inventive concept is not limited thereto, and colors displayed by the pixels may vary.

In an exemplary embodiment of the inventive concept, the display panel 20 may be an organic light-emitting diode (OLED) display panel, in which each of the pixels PX includes a light-emitting element, e.g., an OLED. However, the inventive concept is not limited thereto, and the display panel 20 may be a different type of flat panel display or a flexible display panel.

The gate driver 300 may drive the plurality of gate lines GL of the display panel 20 by using a gate driver control signal GCS (e.g., a gate timing control signal) received from the timing controller 200. The gate driver 300 may apply pulses of a gate-on voltage, e.g., a scan voltage or a sensing-on voltage, to each of the plurality of gate lines GI, when driving each of the plurality of gate lines GL, based on the gate control signal GCS.

The data driver 100 includes a driving block 110 and a sensing block 120, and may drive the plurality of pixels PX via the plurality of data lines DL and sense (e.g., measure) electrical characteristics of the plurality of pixels PX via the sensing lines SL.

The driving block 110 may digital-to-analog convert image data, e.g., compensated input data CDT (also referred to as 'compensated data') for each of the plurality of pixels PX, which is received from the timing controller 200, and provide the display panel 20 with driving signals, which are analog signals converted from the input data, via the data lines DL. Each of the driving signals may be provided to one of the plurality of pixels PX.

Figure 6:
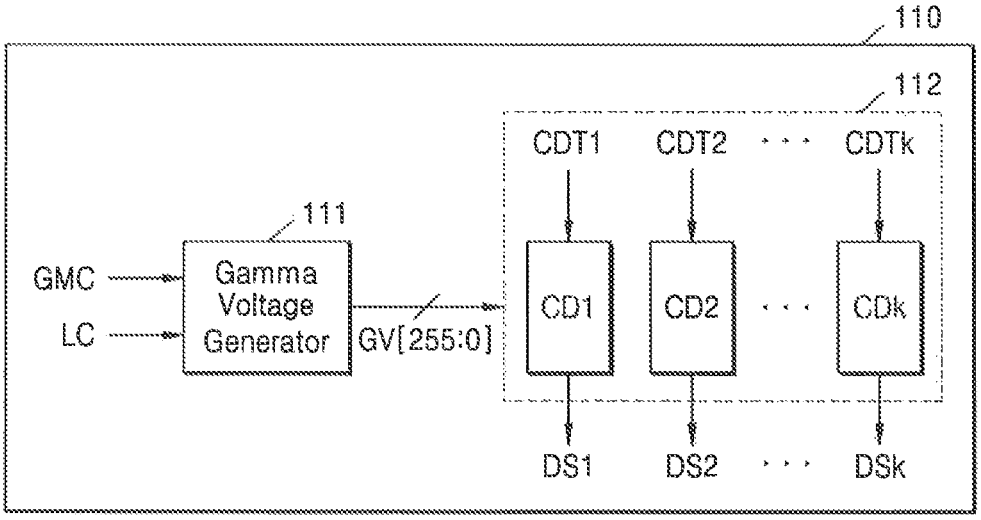
FIG. 6 is a block diagram of a driving block of a data driver according to an exemplary embodiment of the inventive concept.

In a display mode or a sensing mode, the driving block 110 may convert image data provided from the timing controller 200 or internally set data for sensing into driving signals, e.g., driving voltages, and output the driving voltages to the data lines DL of the display panel 20. The driving block 110 may include a plurality of channel drivers as shown in FIG. 6, and each of the plurality of channel drivers may convert received data, e.g., compensated input data CDT, into a driving signal. The plurality of channel drivers perform digital-to-analog conversion, and thus, may be referred to as digital-to-analog converters.

The sensing block 120 may measure electrical characteristics of the plurality of pixels PX periodically or non-periodically. The sensing block 120 may sense (e.g., measure) the electrical characteristics of the plurality of pixels PX in the sensing mode. The sensing mode may be set during the manufacture of the display device 1, a booting period after the display device 1 is powered on, an ending period of a power-off period, or a dummy interval (or a vertical blanking interval) between frame display periods of the display panel 20.

The sensing block 120 may receive a sensing signal, e.g., a pixel voltage or pixel current, representing electrical characteristics of each of the plurality of pixels PX via the plurality of sensing lines SL, and analog-to-digital convert the sensing signal into sensing data SDT.

The timing controller 200 may control overall operations of the display device 1 and control driving timings of the data driver 100 and the gate driver 300, based on control commands CMD received from an external processor. The external processor may be, e.g., a main processor of an electronic device having the display device 1 installed thereon or an image processor. The timing controller 200 may be embodied by hardware, software, or a combination of hardware and software. For example, the timing controller 200 may be implemented with digital logic circuits and registers that perform functions described below.

The timing controller 200 may provide a data driver control signal DCS to the data driver 100. Operations of the driving block 110 and the sensing block 120 of the data driver 100 and time points at which the driving block 110 and the sensing block 120 are to be operated may be controlled in response to the data driver control signal DCS.

Furthermore, the timing controller 200 may provide the gate driver control signal GCS to the gate driver 300, As described above, the gate driver 300 may drive the plurality of gate lines GL of the display panel 20 in response to the gate driver control signal GCS.

In addition, the timing controller 200 may perform various image processing operations on image data received from an external processor, for example, to change a format of the image data or reduce power consumption. The image data may include input data IDT (also referred to as 'image data') of FIG. 2 corresponding to each of the pixels PX. The timing controller 200 may perform data compensation on the image data EDT of each of the pixels PX of the display panel 20 and provide compensated data CDT to the data driver 100. To accomplish this, the timing controller 200 may include a degradation compensation block 210.

The degradation compensation block 210 may divide the plurality of pixels PX into a plurality of pixel blocks PXB, calculate an accumulated degradation value of each of the plurality of pixel blocks PXB, and perform data compensation with respect to the plurality of pixel blocks PXB, based on the calculated accumulated degradation values and a degradation model.

The plurality of pixel blocks PXB may include pixels PX arranged adjacent to each other. FIG. 1 illustrates an example in which a pixel block PXB includes 2×2 pixels PX arranged in two rows and two columns. However, the inventive concept is not limited thereto, and the size of the pixel block PXB may vary. In an exemplary embodiment of the inventive concept, the degradation compensation block 210 may calculate an accumulated degradation value of each of the plurality of pixels PX and perform data compensation with respect to a corresponding pixel PX, based on the calculated accumulated degradation value and a degradation model.

The accumulated degradation value may be obtained by accumulating degradation values calculated for a certain time period (e.g., in units of frames), based on compensated input data provided to the pixels PX of the pixel block PXB or driving data corresponding to a driving signal provided to the pixels PX. The driving data is obtained by reflecting luminance characteristics and gamma characteristics into compensated input data and may be a digital value representing a level, e.g., a voltage, of the driving signal.

In addition, the degradation compensation block 210 may correct the accumulated degradation value, based on the sensing data SDT received from the data driver 100. The degradation compensation block 210 may select at least one pixel block MB having a high degree of degradation from among the plurality of pixel blocks PXB as a sensing pixel block whose electrical characteristics are to be sensed, and control the sensing block 120 of the data driver 100 to sense the electrical characteristics of the sensing pixel block. The degradation compensation block 210 may correct an accumulated degradation value corresponding to the sensing pixel block, based on the sensing data SDT received from the data driver 100. The degradation compensation block 210 may perform data compensation on the sensing pixel block, based on the corrected accumulated degradation value, and perform data compensation on the other pixel blocks, based on accumulated degradation values corresponding thereto. In an exemplary embodiment of the inventive concept, a sensing cycle of sensing the electrical characteristics of the selected sensing pixel block may be equal to or longer than an accumulation cycle of accumulating degradation values. In addition, a cycle of performing, data sensing on one pixel block may be longer than the accumulation cycle. A configuration and operation of the degradation compensation block 210 will be described in detail below.

As described above, the display device 1 according to an exemplary embodiment of the inventive concept may calculate an accumulated degradation value of each of the plurality of pixel blocks PXB, based on the degradation model method, perform data compensation based on the accumulated degradation value, selectively generate an actual degradation rate of at least one pixel block PXB according to a characteristic sensing method, and correct the accumulated degradation values, based on the actual degradation rate, thereby increasing a consistency ratio between the accumulated degradation value and the actual degradation rate.

When only the degradation model method is used for data compensation to prevent degradation of image quality due to pixel degradation, data compensation efficiency may decrease when a consistency ratio between the degradation model and an actual degradation rate is low according to a driving environment. Moreover, even when the data compensation is performed, a degree of actual degradation is not reflected, and thus, luminous uniformity and image quality of the display panel 20 may decrease.

In addition, when only the characteristic sensing method is used for data compensation, a time for sensing characteristics (e.g., a time for which the sensing mode is driven) is additionally required, and characteristics are sensed in real time fora degraded region. However, when electrical characteristics are sensed simultaneously with the driving of a display, an unintended image may be output on the display panel 20.

However, the display device 1 according to an exemplary embodiment of the inventive concept performs data compensation, based on the degradation model method using an accumulated degradation value, and corrects the accumulated degradation value, based on the characteristic sensing method. Thus, characteristic sensing does not have to be performed in real time. Accordingly, restrictions on a characteristic sensing cycle may be relaxed, a consistency ratio between the accumulated degradation value and an actual degradation rate may be increased, and data compensation may be performed based on the accumulated degradation value even when characteristic sensing, is not performed on a pixel block. Accordingly, luminous uniformity and reliability of the display panel 20 may be increased.

Figure 2:
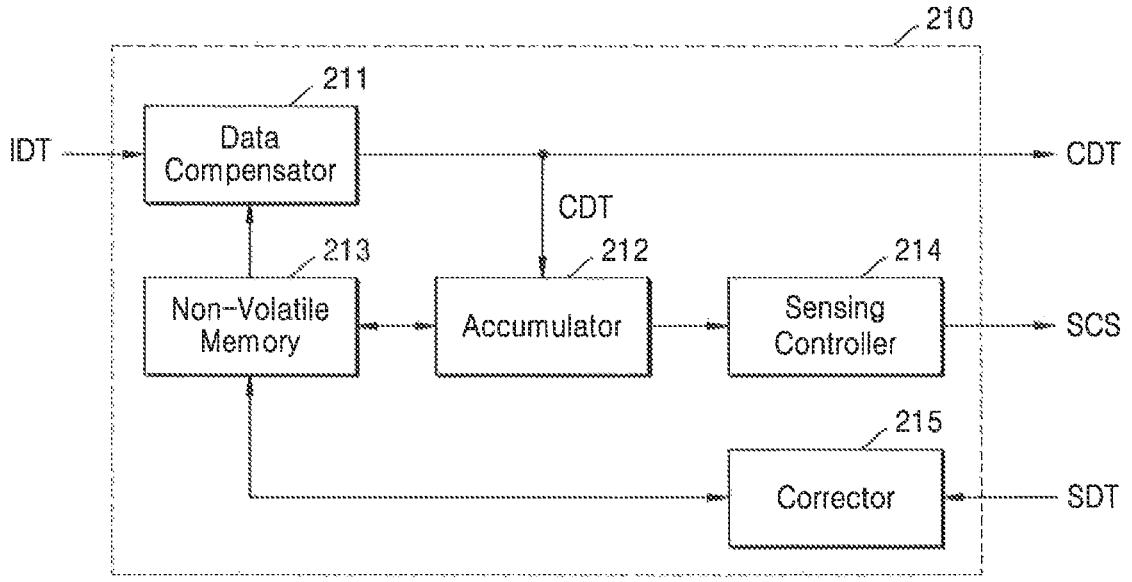
FIG. 2 is a block diagram of a degradation compensation block according to an exemplary embodiment of the inventive concept.

FIG. 2 is a schematic block diagram of a degradation compensation block according to an exemplary embodiment of the inventive concept FIG. 2 illustrates an example of the degradation compensation block 210 of FIG. 1. The above description of the degradation compensation block 210 with reference to FIG. 1 is applicable to the embodiment of FIG. 2.

Referring to FIG. 2, the degradation compensation block 210 may include a data compensator 211, an accumulator 212, a nonvolatile memory 213, a sensing controller 214, and a corrector 215.

The data compensator 211 may generate compensated data CDT by performing data compensation on input data IDT by, using an accumulated degradation value and a degradation model. In this case, the degradation model may represent the relationship between the accumulated degradation value and a degradation rate as illustrated in FIG. 3.

Figure 3:
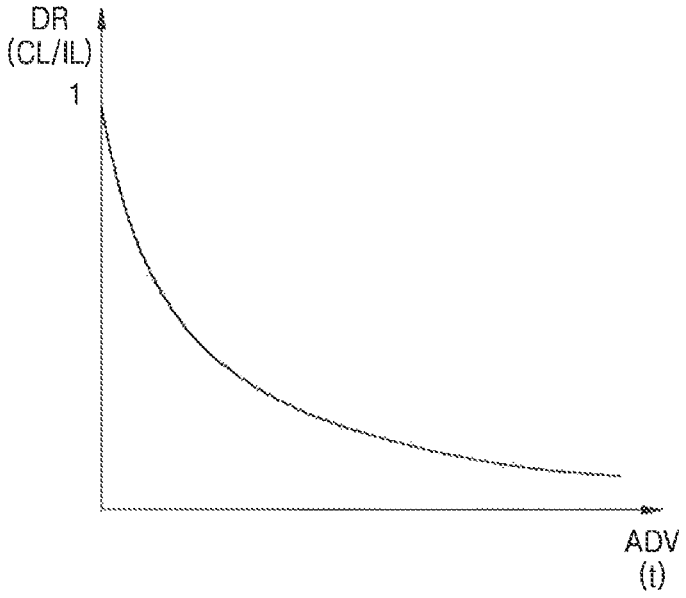
FIG. 3 is a graph showing an example of a degradation model.

FIG. 3 is a graph showing an example of a degradation model. In FIG. 3, the horizontal axis represents an accumulated degradation value ADV and the vertical axis represents a degradation rate DR. Assuming that the same driving signal is continuously received for a pixel or a pixel group, the accumulated degradation value ADV may be represented over time t.

The degradation rate DR is an index indicating a degree of degradation of the pixel or the pixel group and may be expressed, for example, as a ratio of a current luminance CL to an initial luminance IL. When the accumulated degradation value ADV is small, for example, at the beginning of the driving of the display panel 20 the degradation rate DR high, e.g., However, as a light emission time of the pixel increases due to the driving of the display panel 20, the accumulated degradation value ADV may increase and the degradation rate DR may decrease.

Rescuing back to FIG. 2, the data compensator 211 may convert an accumulated degradation value of each of a plurality of pixel blocks into a degradation rate by using a degradation model and perform data compensation for input data IDT, based on a plurality of degradation rates corresponding to the plurality of pixel blocks. The input data IDT represents a gradation of a driving signal to be applied to a pixel. The data compensator 211 may increase or decrease the gradation of the driving signal through data compensation. Compensated data CDT may be provided to the driving block 110 of the data driver 100 in FIG. 1.

The accumulator 212 may receive the compensated data CDT, and calculate and accumulate degradation values to generate an accumulated degradation value, based on the compensated data CDT. The accumulated degradation value indicates a degree of deterioration of the pixel over time, and thus, is to be updated over time, starting from a time point at which the display panel 20 of FIG. 1 starts to display an image. The accumulated degradation value should not be reset or lost. Thus, the accumulator 212 may store the accumulated degradation value in the nonvolatile memory 213, so that the accumulated degradation value may not be lost even when the supply of power to the display device 1 of FIG. 1 is interrupted.

The nonvolatile memory 213 may include read-only memory (ROM), programmable ROM (PROM), electrically programmable ROM (EPROM), electrically erasable and programmable ROM (EEPROM), a flash memory, phase-change RAM (PRAM), magnetic RAM (MRAM), resistive RAM (RRAM), ferroelectric RAM (FRAM), or the like. Here, 'RAM' refers to random access memory. In an exemplary embodiment of the inventive concept, the nonvolatile memory 213 may be embodied as part of the accumulator 212.

The sensing controller 214 may select at least one pixel block on which electrical characteristic sensing is to be performed, based on the plurality of accumulated degradation values corresponding to the plurality of pixel groups, and control the sensing block 120 of the data driver 100 of FIG. 1 to perform electrical characteristic sensing on either a sensing pixel block selected according to a sensing cycle or a region including the selected sensing pixel block.

The sensing controller 214 may provide a sensing control signal SCS to the sensing block 120. The sensing block 120 may perform electrical characteristic sensing on the sensing pixel block in response to the sensing control signal SCS. In an exemplary embodiment of the inventive concept, the sensing control signal SCS may include information regarding the sensing cycle, a location of the sensing pixel block, a sensing method, etc. The sensing method may include, for example, measuring a threshold voltage of a driving transistor included in a pixel, measuring a potential difference at both ends of a light-emitting element provided in the pixel, or measuring the amount or mobility of current flowing through the light-emitting element.

The corrector 215 may correct the accumulated degradation value of the sensing pixel block, based on the sensing data SDT received frons the sensing block 120 of the data driver 100. The sensing data SDT may include a threshold voltage of a driving transistor included in the pixel, a potential difference at both ends of the light-emitting element provided in the pixel, or the amount or mobility of current flowing through the light emitting element.

The corrector 215 may obtain the accumulated degradation value of the sensing pixel block from the nonvolatile memory 213 and correct the accumulated degradation value, based on the sensing data SDT. The corrector 215 may store, in the non-volatile memory 213, the corrected accumulated degradation value as an accumulated degradation value of the sensing pixel block.

Thereafter, to perform data compensation on input data IDT received for a subsequent frame, the data compensator 211 may perform data compensation on input data IDT corresponding to a sensing pixel block among the plurality of pixel blocks, based on the corrected accumulated degradation value, and perform data compensation on input data IDT corresponding to the other pixel blocks, based on the accumulated degradation value generated and stored by the accumulator 212.

Figure 4:
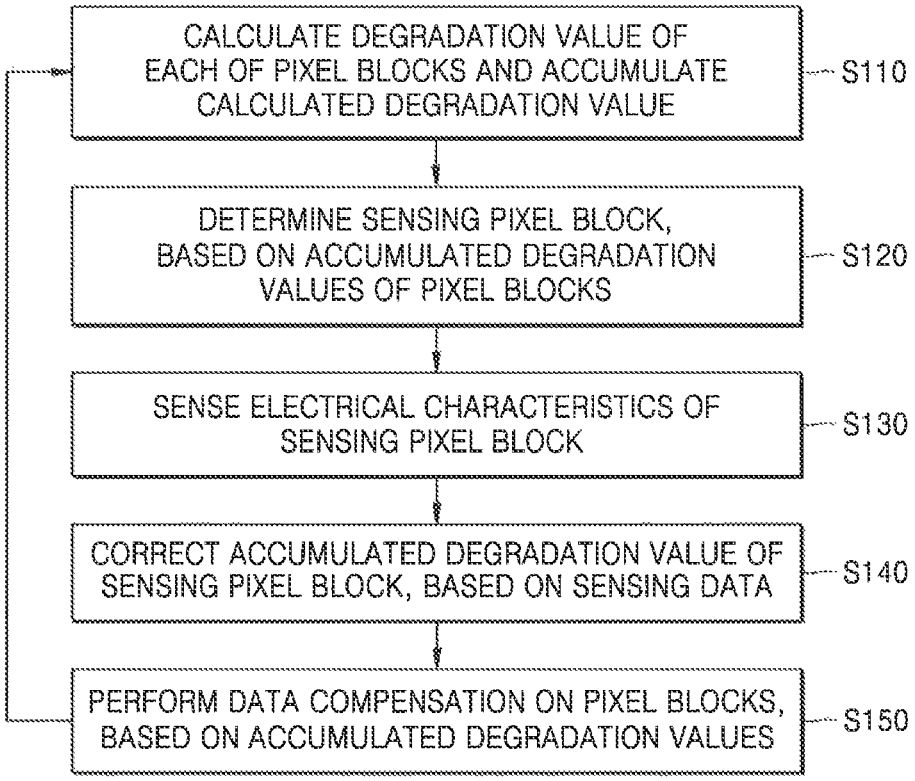
FIG. 4 is a flowchart of a data compensation method of a display device according to an exemplary embodiment of the inventive concept.

FIG. 4 is a flowchart of a data compensation method of a display device according to an exemplary embodiment of the inventive concept.

Referring to FIGS. 2 and 4, the accumulator 212 may calculate degradation values of a plurality of pixel blocks and accumulate the calculated degradation values (S110). As the calculated degradation values are accumulated, an accumulated degradation value may be obtained and the accumulator 212 may store the accumulated degradation value in the nonvolatile memory 213.

The sensing controller 214 may determine a sensing pixel block, the electrical characteristics of which are to be sensed, based on a plurality of accumulated degradation values of the plurality of pixel blocks (S120). The sensing controller 214 may determine, as a sensing pixel block, at least one pixel block having a relatively high accumulated degradation value among the plurality of pixel blocks. A degree of degradation of the sensing pixel block having a higher accumulated degradation value may be higher than those of the other pixel blocks. When the degree of degradation is high, a consistency ratio between the accumulated degradation value and a degradation rate may decrease. Accordingly, the sensing controller 214 may control electrical data sensing to be performed on the sensing pixel block to correct an accumulated degradation value of a pixel block whose degree of degradation is estimated to be highest.

The sensing block 120 of FIG. 1 may sense (e.g., measure) the electrical characteristics of the sensing pixel block under control of the sensing controller 214 (S130). As described above, the sensing block 120 may sense at least one of various electrical characteristics. The sensing block 120 may provide the corrector 215 with sensing data indicating the sensed electrical characteristics.

The corrector 215 may correct the accumulated degradation value of the sensing pixel block, based on the sensing data (S140).

The data compensator 211 may perform data compensation on the plurality of pixel blocks, based on the plurality of accumulated degradation values (S150). In this case, the accumulated degradation value of the sensing pixel block may be an accumulated degradation value corrected based on the sensing data.

After data compensation is performed, operations S110 to S150 may be performed again to generate an accumulated degradation value based on the compensated data and correct the accumulated degradation value based on the sensing data.

Figure 5:
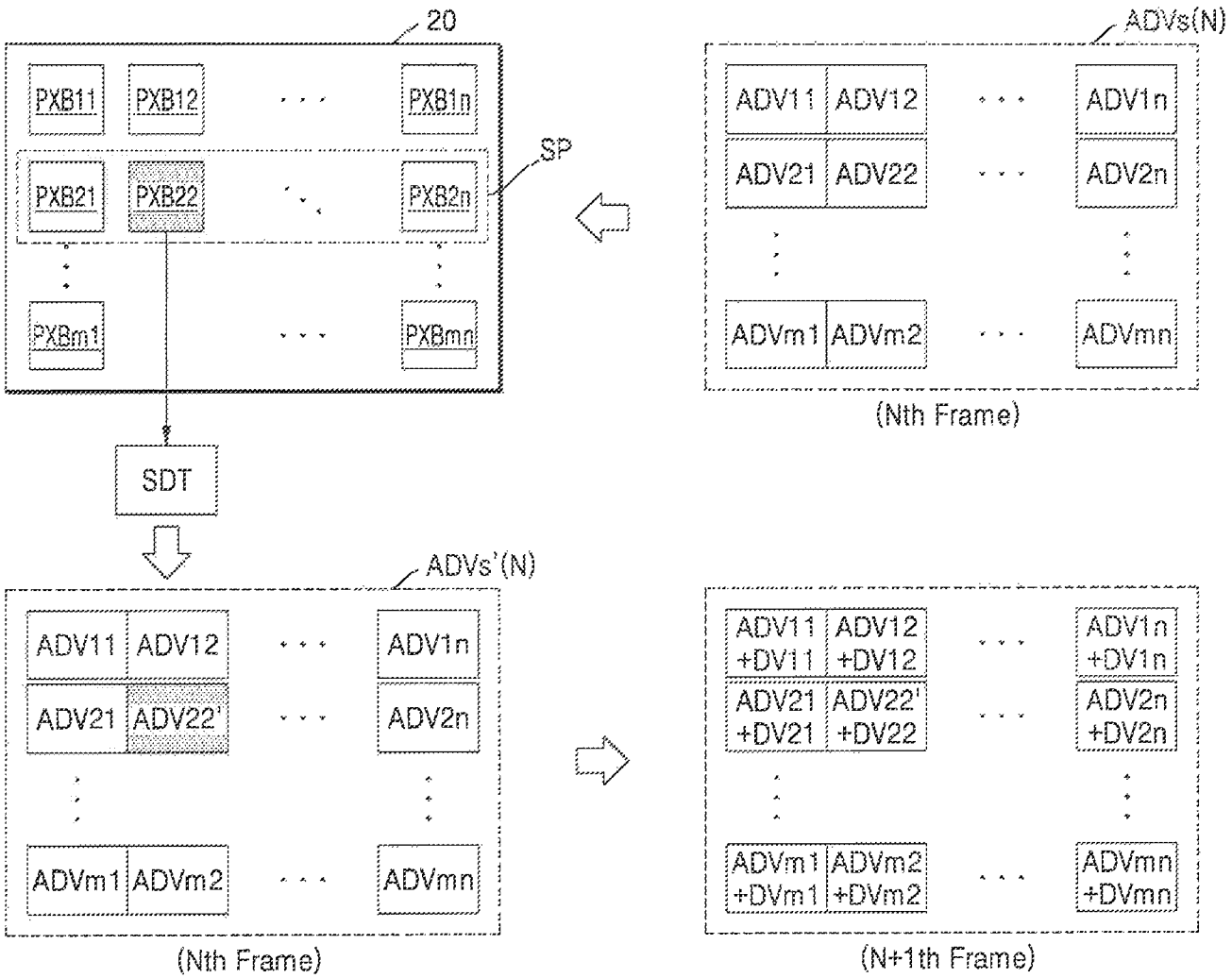
FIG. 5 is a diagram for explaining a data compensation method according to an exemplary embodiment of the inventive concept.

FIG. 5 is a diagram for explaining a data compensation method according to an exemplary embodiment of the inventive concept. The data compensation method of FIG. 5 may be performed by the degradation compensation block 210 of FIG. 2.

Referring to FIG. 5, the display panel 20 may include a plurality of pixel blocks PXB11 to PXBmn (here, m and n are integers greater than or equal to 2), and each of the plurality of pixel blocks PXB11 to PXBmn may include at least one pixel.

In an N-th frame, accumulated degradation values respectively corresponding to a plurality of pixel blocks PXB11 to PXBmn e.g., a plurality of accumulated degradation values ADVs(N), may be stored in the nonvolatile memory 213. A sensing pixel block may be determined based on the plurality of accumulated degradation values ADVs(N). For example, when the accumulated degradation value ADV22 among the plurality of accumulated degradation values ADVs(N) is largest, the pixel block PXB22 corresponding to the accumulated degradation value ADV22 may be determined as a sensing pixel block. Electrical characteristic sensing may be performed on the pixel block PXB22, and sensing data SDT may be generated. The accumulated degradation value ADV22 may be corrected based on the sensing data SDT. Thus, updated accumulated degradation values ADVs'(N) of the N-th frame may be stored.

In an exemplary embodiment of the inventive concept, a position of a region including the pixel block PXB22 is determined as a sensing position SP, and sensing may be performed on the pixel blocks PXB21 to PXB2*n* provided at the sensing position SP. In this case, sensing data for the pixel blocks PXB21 to PXB2*n* may be generated, and the accumulated degradation values ADV21 to ADV2*n* respectively corresponding to the pixel blocks PXB21 to PXB2*n* may be corrected, based on the sensing data.

Next, when input data IDT corresponding to an (N+1)th frame is received, data compensation may be performed based on the updated accumulated degradation values ADVs'(N) of the N-th frame and a degradation model.

Thereafter, a plurality of accumulated degradation values ADVs(N+1) of the (N+1)th frame may be generated by accumulating (e.g., adding) degradation values DV11 to DVmn, which are generated based on compensated data, to the updated accumulated degradation values ADVs'(N) of the N-th frame.

FIG. 6 is a block diagram of a driving, block of a data driver according to an exemplary embodiment of the inventive concept. A driving block 110 of FIG. 6 is an example of the driving block 110 of FIG. 1. Therefore, the above description of the driving block 110 with reference to FIG. 1 is applicable to the present embodiment.

Referring to FIG. 6, the driving block 110 may include a gamma voltage generator 111 and a plurality of channel drivers 112.

The gamma voltage generator 111 may generate a plurality of gamma voltages GV[255:0], based on a gamma control signal GMC. Although FIG. 6 illustrates that the gamma voltage generator 111 generates 256 gamma voltages, the inventive concept is not limited thereto.

The gamma voltage generator 111 may generate the plurality of gamma voltages GV [255:0] according to a gamma curve set based on the gamma control signal GMC. The gamma control signal GMC may be received from the timing controller 200 of FIG. 1. Each of the plurality of gamma voltages GV[255:0] may vary depending on the gamma curve. For example, a voltage corresponding to the same gradation when the gamma voltage generator 111 generates the gamma voltages GV[255:0] according to a gamma curve targeting gamma 2.2, may be different from that when the gamma voltage generator 111 generates the gamma voltages GV[255:0] according to a gamma curve targeting gamma 1.0. For example, 127-gradation gamma voltages GV[127] in a case of gamma 2.2 may be different from 127-gradation gamma voltages GV[127] in a case of gamma 1.0. For example, the 127-gradation gamma voltages GV[127] in the case of gamma 2.2 may be lower than the 127-gradation gamma voltages GV[127] in the case of gamma 1.0. In addition, a gamma curve targeting gamma 2.2 may be set in the display device 1 of FIG. 1.

Each of the plurality of channel drivers 112 may receive the plurality of gamma voltages GV[255:0] and output driving signals DS1 to DSk (here, k is an integer greater than or equal to 2) corresponding, to input data, e.g., compensated data, to corresponding pixels by using the plurality of gamma voltages GV[255:0]. For example, a first channel driver CD1 may output, as a driving signal DS1, a gamma voltage corresponding to the first compensated data CDT1 among the plurality of gamma voltages GV[255:0], based on first compensated data CDT1. Operations of second to k-th channel drivers CD2 to CDk are similar to that of the first channel driver CD1.

Figure 7:
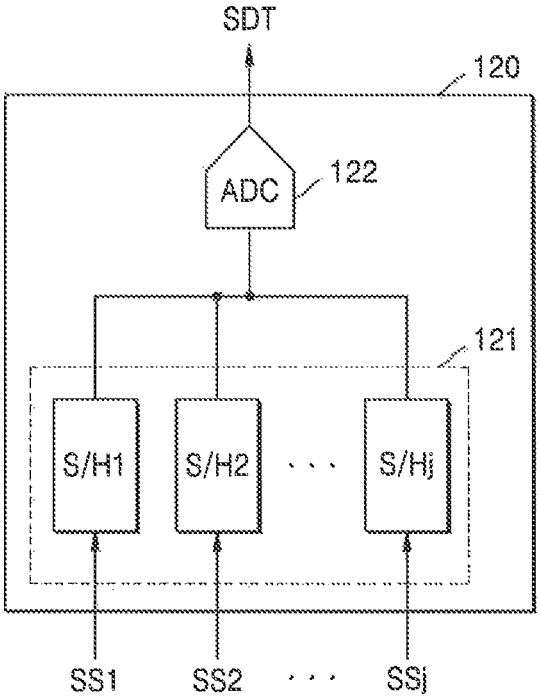
FIG. 7 is a block diagram of a sensing block of a data driver according to an exemplary embodiment of the inventive concept.

FIG. 7 is a block diagram of a sensing block of a data driver according to an exemplary embodiment of the inventive concept. A sensing block 120 of FIG. 7 is an example of the sensing block 120 of FIG. 1. Therefore, the above description of the sensing block 120 with reference to FIG. 1 is applicable to the current embodiment.

Referring to FIG. 7, the sensing block 120 may include a plurality of sample/hold circuits 121 and an analog-to-digital converter (ADC) 122.

The plurality of sample/hold circuits 121 may simultaneously sample a plurality of sensing signals SS1 to SSj (here, j is an integer equal to or greater than 2) received from the display panel 20 of FIG. 1, and then, sequentially output the sampled signals to the ADC 122. The ADC 122 may generate sensing data SDT by analog-to-digital converting the plurality of sensing signals SS1 to SSj sequentially received from the plurality of sample/hold circuits 121. The sensing block 120 may transmit the sensing data SDT to the corrector 215 of the degradation compensation block 210.

Figure 8:
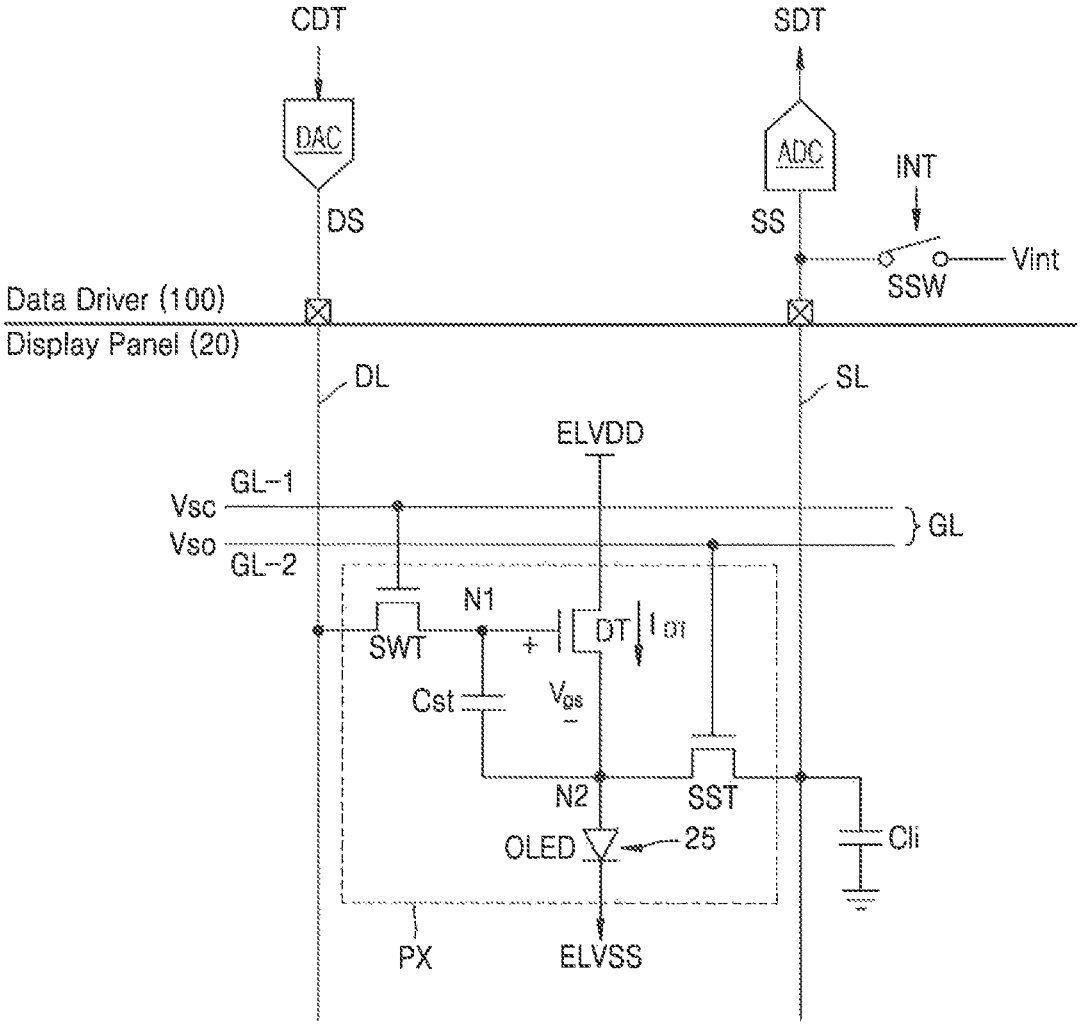
FIG. 8 illustrates an equivalent circuit of a pixel according to an exemplary embodiment of the inventive concept.

FIG. 8 illustrates an equivalent circuit of a pixel according to an exemplary embodiment of the inventive concept. Some components of the data driver 100 will be illustrated together for convenience of explanation.

Referring to FIG. 8, a pixel PX may include a switching transistor SWT, a driving transistor DT, an OLED 25, a storage capacitor Cst, and a sensing transistor SST. However, a configuration and structure of the pixel PX of FIG. 8 are merely exemplary and thus may be variously changed.

A first driving voltage ELVDD and a second driving voltage ELVSS may be applied to the pixel PX. The first driving voltage ELVDD may be higher than the second driving voltage ELVSS.

The switching transistor SWT, the sensing transistor SST, and the driving transistor DT may be amorphous silicon (a-Si) thin-film transistors (TFTs), polysilicon (poly-Si) TFTs, oxide TFTs, organic TFTs, or the like.

Gate lines GL connected to the pixel PX may include a first gate line GL-1 and a second gate line GL-2. The switching transistor SWT may be connected to the first gate line GL-1 and a data line DL, and turned on to provide a driving signal DS, e.g., a driving voltage, supplied via the data line DL to a gate node N1 of the driving transistor DT, in response to a scan voltage Vsc applied via the first gate line GL-1. The drive signal DS may be generated by a digital-to-analog converter (DAC) (e.g., a channel driver) of the data driver 100.

The sensing transistor SST may be connected to the second gate line GL-2 and a sensing line SL and turned on by a sensing-on voltage Vso applied via the second gate line GL-2. In this case, a sensing switch SSW of the data driver 100 may be turned on in response to an initial signal INT to supply an initialization voltage Vim (or a reset voltage) to the pixel PX via the sensing line SL. The sensing transistor SST may provide the initialization voltage Vint applied from the data driver 100 to a source node N2 of the driving transistor DT. In a sensing mode, the sensing transistor SST may be turned on to output current from the driving transistor DT or the OLED 25 to the sensing line SL.

The storage capacitor Cst may store the difference between a data voltage Vd applied to the gate node N1 of the driving transistor DT via the switching transistor SWT and the initialization voltage Vint applied to the source node N2 of the driving transistor DT via the sensing transistor SST, so that a driving voltage Vgs may be applied to the driving transistor DT for a certain time period, e.g., a duration of one frame.

The first driving voltage ELVDD is applied to a drain node of the driving transistor DT, and the driving transistor UT may provide the OLED 25 with a driving current $I_{DT}$ proportional to the driving voltage Vgs.

The OLED 25 includes an anode connected to the source node N2 of the driving transistor DT, a cathode to which the second driving voltage ELVSS is applied, and an organic emission layer between the cathode and the anode. The cathode may be a common electrode shared by pixels. In the OLED 25, light may be generated by the organic emission layer when the driving current $I_{DT}$ is supplied from the driving transistor DT. The intensity of the light may be proportional to the driving current $I_{DT}$. The driving current $I_{DT}$ may be expressed by Equation 1 below.

$$I_{DT}=\beta(Vgs-Vth)^2=\beta(Vd-V\text{int}-Vth)^2, \quad \text{[Equation 1]}$$

wherein β represents a constant determined by current mobility of the driving transistor DT and Vth represents a threshold voltage of the driving transistor DT.

In the sensing mode, electrical characteristics of the pixel PX may be measured. The switching transistor SWT may supply a sensing data voltage applied via the data line DL to the driving transistor DT. When the sensing transistor SST is turned on, a current $I_{DT}$ proportional to the difference between a voltage of the gate node N1 and a voltage of the source node N2 of the driving transistor DT, e.g., the driving voltage Vgs, may flow to the sensing line SL, thereby charging a parasitic capacitor of the sensing line SL, e.g., a line capacitor Cli.

According to various sensing sequences, a sensing signal SS received via the sensing line S1, may be converted into sensing data SDT by the ADC when the voltage of the source node N2 of the driving transistor DT reaches a saturation state or when the voltage of the source node N2 linearly increases. The sensing signal SS measured when the voltage of the source node N2 reaches the saturation state may include information regarding the threshold voltage Vth of the driving transistor DT. The sensing signal SS measured when the voltage of the source node N2 linearly increases may include information regarding the current mobility of the driving transistor DT. However, the inventive concept is not limited thereto, and electrical characteristics may be sensed by various sensing methods or sequences.

Figure 9:
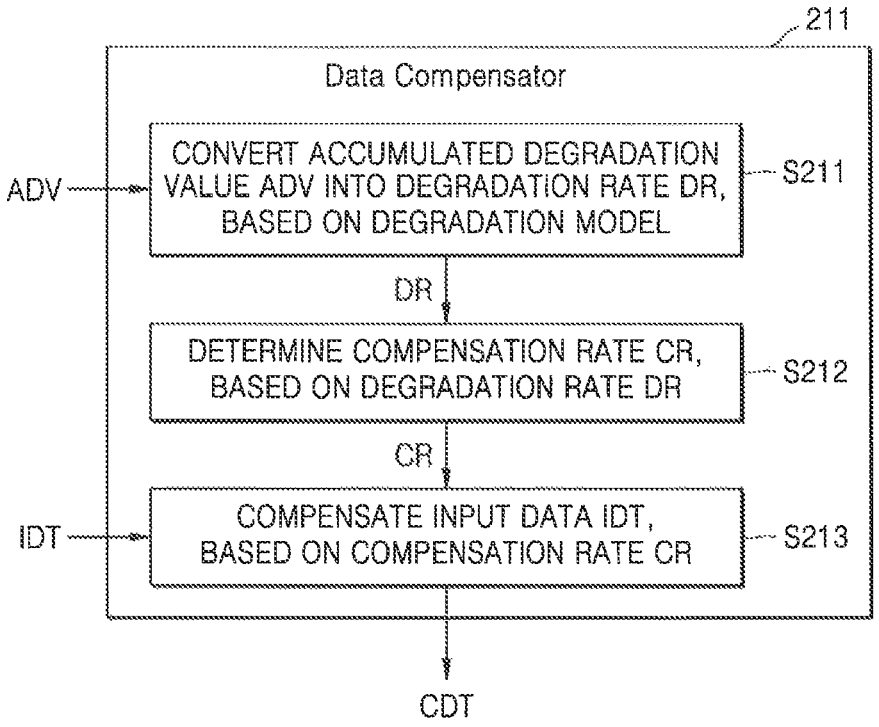
FIG. 9 is a diagram illustrating an operation of a data compensator of FIG. 2 in more detail.

FIG. 9 is a diagram illustrating an operation of the data compensator 211 of FIG. 2 in more detail.

Referring to FIG. 9, the data compensator 211 may receive an accumulated degradation value ADV and convert the accumulated degradation value ADV into a degradation rate DR, based on a degradation model (S211). The data compensator 211 may generate a plurality of degradation rates DR by converting accumulated degradation values ADV of a plurality of pixel blocks into the plurality of degradation rates DR.

The data compensator 211 may determine a compensation rate CR, based on the degradation rate DR (S212). In an exemplary embodiment of the inventive concept, the data compensator 211 may determine a compensation rate CR, e.g., a luminance compensation ratio, for a plurality of pixel blocks, based on a plurality of degradation rates DR. The data compensator 211 may determine a compensation rate CR of a particular pixel block by comparing a degradation rate DR of the pixel block with a degradation rate DR of a pixel block determined to have a lowest degree of degradation, e.g., a pixel block having a highest degradation rate DR. For example, when a first degradation rate DR1 of a first pixel block is 0.8 and highest and a second degradation rate DR2 of a second pixel block is 0.5, the data compensator 211 may determine, as a compensation rate CR for the second pixel block, 0.8/0.5(=1.6). With the compensation rate CR=1.6, the second degradation rate DR2 of the second pixel block is equal to the first degradation rate DR1. Otherwise, 0.5/0.8(=0.625) may be determined as the compensation rate CR for the first pixel block at which the first degradation rate DR1 of the first pixel block is equal to the second degradation rate DR2. As described above, the data compensator 211 may calculate a compensation rate CR for each of the plurality of pixel blocks by comparing a plurality of degradation rates DR with each other.

When input data IDT is received, the data compensator 211 may compensate the input data IDT, based on the compensation rate CR (S213). For example, when the compensation rate CR for the second pixel block is 1.6, the data compensator 211 may generate, as compensated data CDT, gradation data to increase the luminance of the pixels of the second pixel block 1.6 times, based on the relationship between the gradation data and the luminance. Otherwise, when the compensation rate CR for the first pixel block is 0.625, the data compensator 211 may generate, as compensated data CDT, gradation data to decrease the luminance of the pixels of the first pixel block 0.625 times, based on the relationship between the gradation data and the luminance.

Figure 10A:
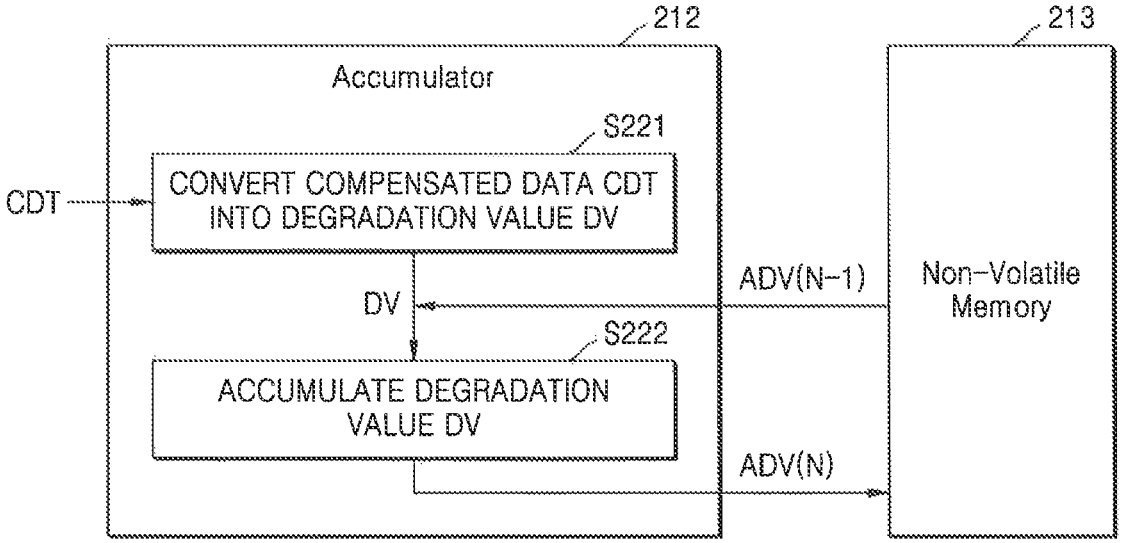
FIGS. 10A and 10B illustrate an operation of an accumulator of FIG. 2.
Figure 10B:
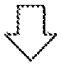

FIGS. 10A and 10B illustrate an operation of the accumulator 212 of FIG. 2.

Referring to FIG. 10A, the accumulator 212 may convert compensated data CDT output from the data compensator 211 into a degradation value DV (S221). For example, referring to FIG. 10B, a degradation value DV of a first pixel block PXB1 may be determined to be 1 and a degradation value DV of a second pixel block PXB2 may be determined to be 0.5, when compensated data CDT of the first pixel block PXB1 has 255 gradations, compensated data CDT of the second pixel block PXB2 has 127 gradations. In this case, a maximum gradation that the compensated data CDT may have is 255. The degradation value DV may be determined relative to reference data corresponding to an input voltage of the degradation model, e.g., a highest gradation (or data having, a highest value).

The accumulator 212 may accumulate the degradation value DV (S222), The accumulator 212 may generate an accumulated degradation value ADV(N) of a current frame, e.g., an N-th frame, by reading an accumulated degradation value ADV(N−1) of a previous frame, e.g., an (N−1)th frame (hereinafter referred to as a 'previous accumulated degradation value'), from the nonvolatile memory 213, and then, accumulating (e.g., adding) the degradation value DV to the previous accumulated degradation value ADV(N−1).

Referring to FIG. 10B, when previous accumulated degradation values ADV(N−1) of the first pixel block PXB1 and the second pixel block PXB2 are each 0.5, a current accumulated degradation value ADV(N) of the first pixel block PXB1 may be calculated to be 1.5 by accumulating 1 and 0.5, and a current accumulated degradation value ADV(N) of the second pixel block PXB2 may be calculated to be 1 by accumulating 0.5 and 0.5. The accumulator 212 may store the current accumulated degradation value ADV(N) in the nonvolatile memory 213.

When compensated data CDT for a subsequent frame, e.g., air (N+1)th frame, is received, the accumulator 212 may calculate and accumulate a degradation value DV according to the method described above.

Referring to FIG. 10B, in an (N+1)th frame, a degradation value DV of a first pixel block PXB1 may be determined to be 1 and a degradation value DV of a second pixel block PX132 may be determined to be 0.25, when compensated data CDT of the first pixel block PXB1 has 255 gradations and compensated data CDT of the second pixel block PXB2 has 63 gradations.

The accumulator 212 may read the accumulated degradation value ADV(N) of the N-th frame as a previous accumulated degradation value from the nonvolatile memory 213 and add the calculated degradation value DV to the previous accumulated degradation value. Because previous accumulated degradation values ADV(N) of the first pixel block PXB1 and the second pixel block PXB2 are 1.5 and 1, respectively, the current accumulated degradation value ADV(N+1) of the first pixel block PXB1 may be calculated to be 2.5 by adding 1 and 1.5 and a current accumulated degradation value ADV(N+1) of the second pixel block PXB2 may be calculated to be 1.25 by adding 0.25 and 1. The accumulator 212 may store the current accumulated degradation value ADV(N+1) in the nonvolatile memory 213.

Figure 11:
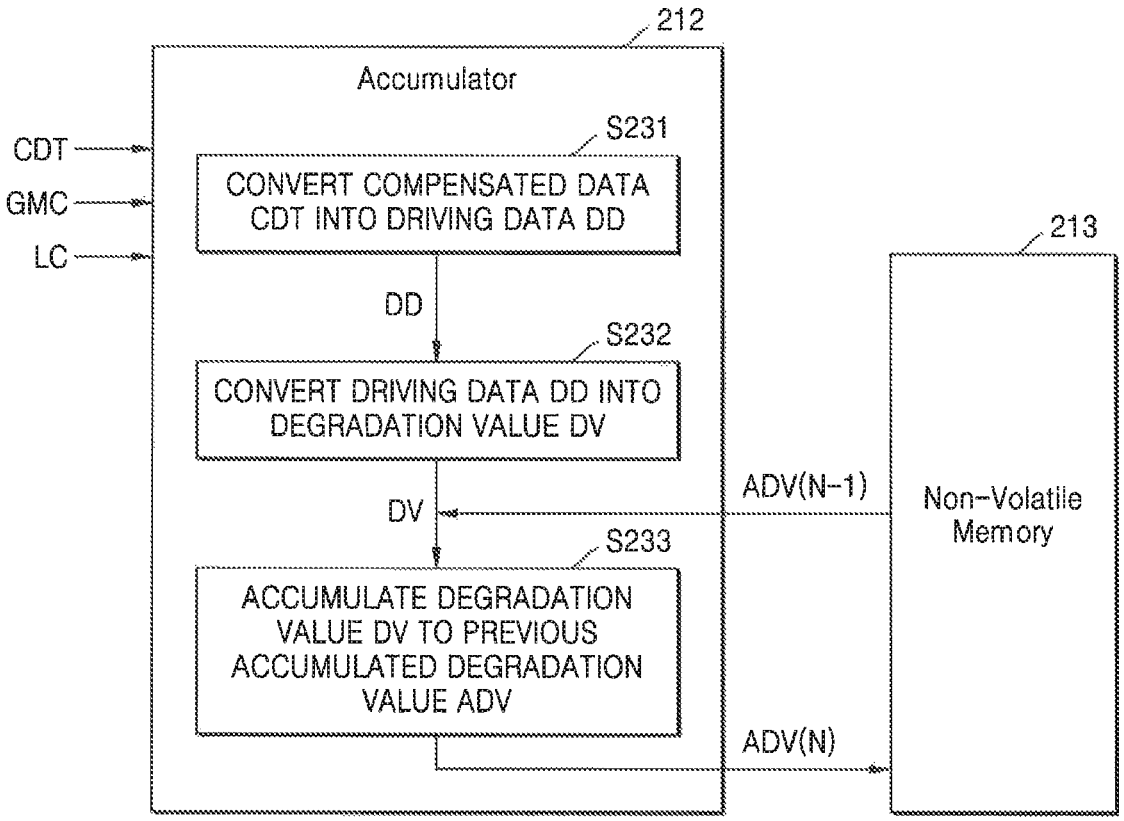
FIG. 11 illustrates an operation of the accumulator of FIG. 2.

FIG. 11 illustrates an operation of the accumulator 212 of FIG. 2.

Retorting to FIG. 11, the accumulator 212 may generate driving data DD by reflecting gamma characteristics and a set luminance into compensated data CDT, and calculate and accumulate a degradation value, based on the driving data DD.

For example, the accumulator 212 may receive the compensated data CDT and additionally receive at least one of a gamma control signal GMC or a luminance control signal LC. The accumulator 212 may convert the compensated data CDT into the driving data DD, based on at least one of the gamma control signal GMC or the luminance control signal LC (S231). The driving data DD is data obtained by reflecting at least one of the gamma characteristics or luminance characteristics into the compensated data CDT and may correspond to a level, e.g., a voltage, of a driving signal applied to a pixel.

The accumulator 212 may convert the driving data DD into a degradation value DV (S232), and accumulate the degradation value DV to a previous accumulated degradation value ADV(N−1) (S233). In other words, the degradation value DV may be added to the previous accumulated degradation value ADV(N−1). Thus, an accumulated degradation value ADV(N) corresponding to a current frame, e.g., an N-th frame, may be generated. The accumulator 212 may store the accumulated degradation value ADV(N) in the nonvolatile memory 213.

As described above with reference to FIG. 6, even when the compensated data CDT represents the same gradations, the level of the driving signal may vary according to the gamma characteristic or the luminance characteristics. Therefore, to more accurately reflect the driving signal DS applied to the pixel, in other words, a stress applied to the pixel, for generation of an accumulated degradation value ADV, the accumulator 212 may convert the compensated data CDT into the driving data DD, based on the gamma control signal GMC or the luminance control signal LC, and generate the accumulated degradation value ADV, based on the driving data DD.

Figure 12:
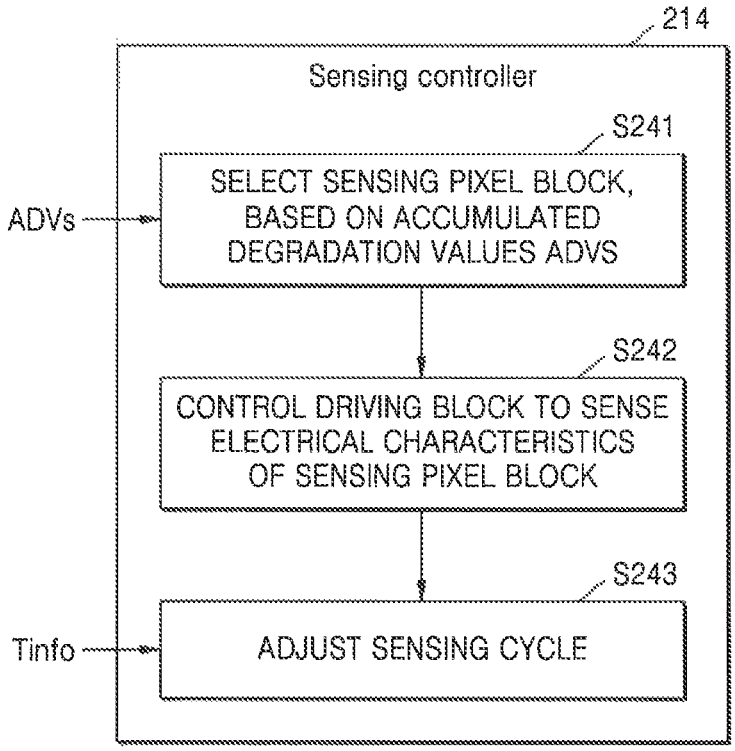
FIG. 12 illustrates an operation of a sensing controller of FIG. 2.

FIG. 12 illustrates an operation of the sensing controller 214 of FIG. 2.

Referring to FIG. 12, the sensing controller 214 may receive a plurality of accumulated degradation values ADVs, which include accumulated degradation values of a plurality of pixel groups, from the nonvolatile memory 213 of FIG. 2 or the accumulator 212 of FIG. 2, and select at least one pixel block as a sensing pixel block, based on the plurality of accumulated degradation values ADVs (S241).

The sensing controller 214 may control the driving block 110 of FIG. 1 to sense electrical characteristics of the sensing pixel block (S242). The sensing controller 214 may adjust a sensing cycle (S243). The sensing controller 214 may adjust the sensing cycle, based on temperature information Tinfo or the plurality of accumulated degradation values ADVs.

In an exemplary embodiment of the inventive concept, the sensing controller 214 may decrease the sensing cycle when a temperature is higher than a reference temperature and increase the sensing cycle when the temperature is lower than the reference temperature.

Figure 13:
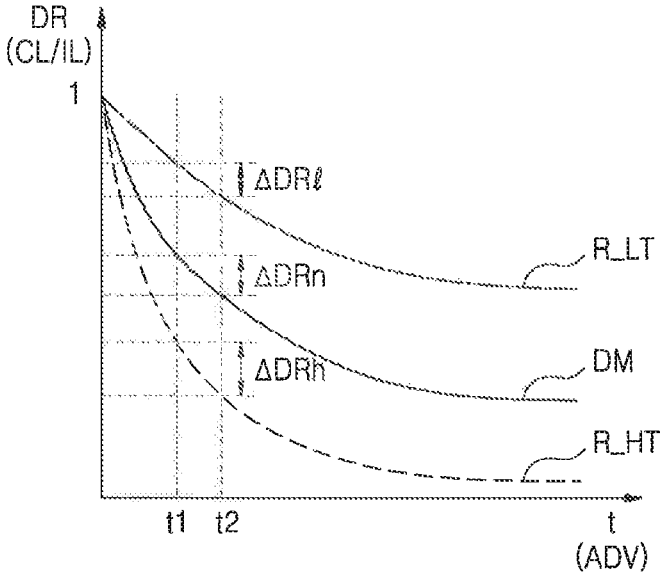
FIG. 13 is a graph showing temperature characteristics versus a degradation rate.

FIG. 13 is a graph showing temperature characteristics versus a degradation rate. The horizontal axis represents time and the vertical axis represents a degradation rate DR. degradation model DM may be generated based on a reference temperature. However, a change of an actual degradation rate DR at a temperature higher or lower than the reference temperature may be different from the degradation model DM. A change of the degradation rate DR from a time point t1 to a time point t2 may be ΔDRn according to the degradation model DM, may be ΔDRh according to an actual degradation rate R_HT at high temperatures, and may be ΔDR according to an actual degradation rate R_LT at low temperatures. A change of the degradation rate DR may be relatively large at high temperatures and be relatively small at low temperatures. As the amount of change of a degradation rate increases, the difference between the degradation model DM and a change of an actual degradation rate may increase.

Therefore, the sensing controller 214 may reduce the sensing cycle to more frequently correct an accumulated degradation rate when a temperature is higher than the reference temperature. In addition, the sensing controller 214 may increase the sensing cycle to reduce the number of corrections of the accumulated degradation rate when the temperature is lower than the reference temperature, based on the temperature information Tinfo.

Figure 14:
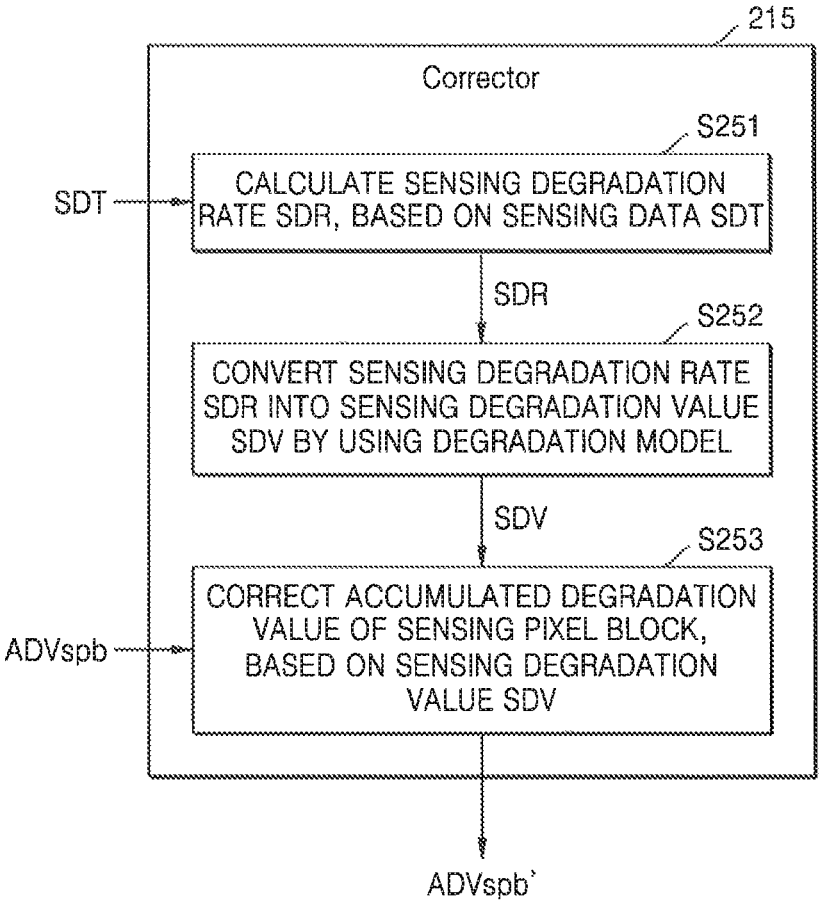
FIG. 14 illustrates an operation of a corrector of FIG. 2.

FIG. 14 illustrates an operation of the corrector 215 of FIG. 2.

Referring to FIG. 14, the corrector 215 may calculate a degradation rate, e.g., a sensing degradation rate, based on sensing data SDT (S251). For example, the corrector 215 may calculate the degradation rate by using a lookup table defining the relationship between characteristic data and degradation rates or a predefined mathematical formula, based on the sensing data SDT. The degradation rate calculated based on the sensing data SDT may be referred to as a sensing degradation rate SDR.

The corrector 215 may convert the sensing degradation rate SDR into a degradation value by using a degradation model (S252). The degradation value generated based on the sensing degradation rate SDR may be referred to as a sensing degradation value SDV.

The corrector 215 may correct an accumulated degradation value of a sensing pixel block, based on the sensing degradation value SDV (S253). In an exemplary embodiment of the inventive concept, the corrector 215 may correct the accumulated degradation value by receiving an accumulated degradation value ADVspb of the sensing pixel block from the nonvolatile memory 213 of FIG. 2 or the accumulator 212 of FIG. 2, and then, calculating the sensing degradation value SDV and an accumulated degradation value ADVspb of the sensing pixel block according to the predefined mathematical formula. Therefore, the accumulated degradation value ADVspb may reflect the sensing degradation value SDR approximating an actual degradation rate. The corrector 215 may store a corrected accumulated degradation value ADVspb' in the nonvolatile memory 213.

Figure 15A:
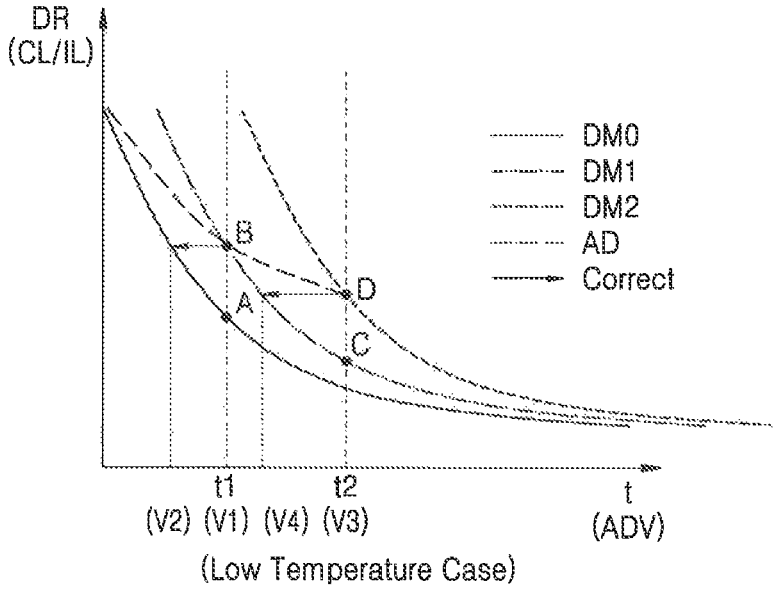
FIGS. 15A and 15B illustrate a process of correcting an accumulated degradation value by a degradation compensation block under a low-temperature condition and a high-temperature condition, according to an exemplary embodiment of the inventive concept.
Figure 15B:
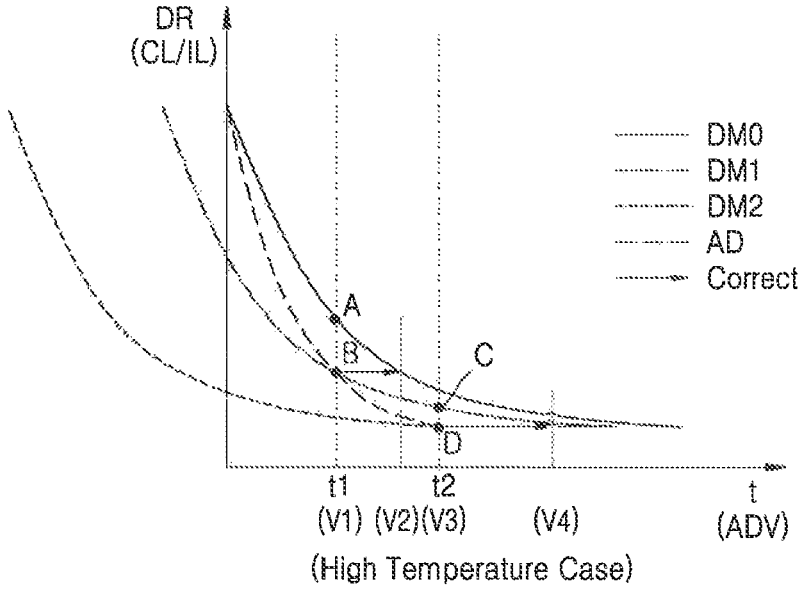

FIGS. 15A and 15B illustrate a process of correcting an accumulated degradation value by a degradation compensation block under a low-temperature condition and a high-temperature condition, according to an exemplary embodiment of the inventive concept. Here, it is assumed that the same driving signal is continuously received for a pixel or a pixel group. Because there is a linear relationship between a time t and an accumulated degradation value ADV, an increase of the accumulated degradation value ADV may be represented according to the lapse of the time t.

A degradation model DM may be different from an actual degradation rate AD at low and high temperatures. In this case, the actual degradation rate AD is the same or similar to a degradation rate calculated based on sensing data.

Referring to FIG. 15A, an amount of change of the actual degradation rate AD at low temperatures may be less than that of the degradation rate DR according to a degradation model DM0.

An accumulated degradation value ADV at a time point t1 may be a first value V1 in this case, a degradation rate A into which the first value V1 is converted using the degradation model DM0 is different from an actual degradation rate B (e.g., a sensing degradation rate) at the time point t1. A sensing degradation value may be obtained by inversely converting the actual degradation rate B by using the degradation model DM0, and a degradation value sensed at the time point t1 may be a second value V2. The accumulated degradation value ADV at the time point t1 may be corrected to the second value V2. In the degradation model DM1, the second value V2 represents a time point earlier than the time point t1. Thus, the accumulated degradation value ADV may be converted into a degradation rate DR later, based on a first degradation model DM1 obtained by shifting the degradation model DM0 to the right on a time axis, such that the degradation model DM0 has the second value V2 at the time point t1. The degradation model DM0 and the first degradation model DM1 are substantially the same.

An accumulated degradation value ADV at a time point t2 may be a third value V3. In this case, a degradation rate C obtained when the third value V3 is converted into a degradation rate DR by using the first degradation model DM1 is different from an actual degradation rate D at the time point t2. A sensing degradation value may be obtained by inversely convening the actual degradation rate D by using the first degradation model DM1, and a degradation value sensed at the time point t2 may be a fourth value V4. The accumulated degradation rate ADV at the time point t2 may be corrected to the fourth value V4. In the first degradation model DM1, the fourth value V4 represents a time point earlier than the time point t2. Thus, the accumulated degradation value ADV may be converted into a degradation rate DR later, based on a second degradation model DM2 obtained by shifting the first degradation model DM1 to the right on the time axis, such that the first degradation model DM1 has the fourth value V4 at the time point t2.

Referring to FIG. 15B, an amount of change of an actual degradation rate AD at high temperatures may be greater than that of the degradation rate DR according to the degradation model DM0.

An accumulated degradation rate ADV at a time point t1 may be a first value V1. In this case, a degradation rate A into which the first value V1 is converted using a degradation model DM0 is different from an actual degradation rate B (e.g., a sensing degradation rate) at the time point t1. A sensing degradation value may be obtained by inversely converting the actual degradation rate B by using the degradation model DM0, and a degradation value sensed at the time point t1 may be a second value V2. The accumulated degradation rate ADV at the time point t1 may be corrected to the second value V2. In the degradation model DM0, the second value V2 represents a time point later than the time point t1. Thus, the accumulated degradation value ADV may be converted into a degradation rate DR later, based on a first degradation model DM1 obtained by shifting the degradation model DM0 to the left on a time axis, such that the degradation model DM0 has the second value V2 at the time point t1. The degradation model DM0 and the first degradation model DM1 are substantially the same.

The accumulated degradation value ADV at a time point t2 may be a third value V3. In this case, a degradation rate C obtained when the third value V3 is converted into a degradation rate DR by using the first degradation model DM1 is different from an actual degradation rate D at the time point t2. A sensing degradation value may be obtained by inversely converting an actual degradation rate D by using the first degradation model DM1, and a degradation value sensed at the time point t2 may be a fourth value V4. The accumulated degradation value ADV at the time point t2 may be corrected to the fourth value V4. In the first degradation model DM1, the fourth value V4 represents a time point later than the time point t2. Thus, the accumulated degradation value ADV may be convened into a degradation rate DR later, based on a second degradation model DM2 obtained by shifting the first degradation model DM1 to the left on the time axis, such that the first degradation model DM1 has the fourth value V4 at the time point t2.

Figure 16:
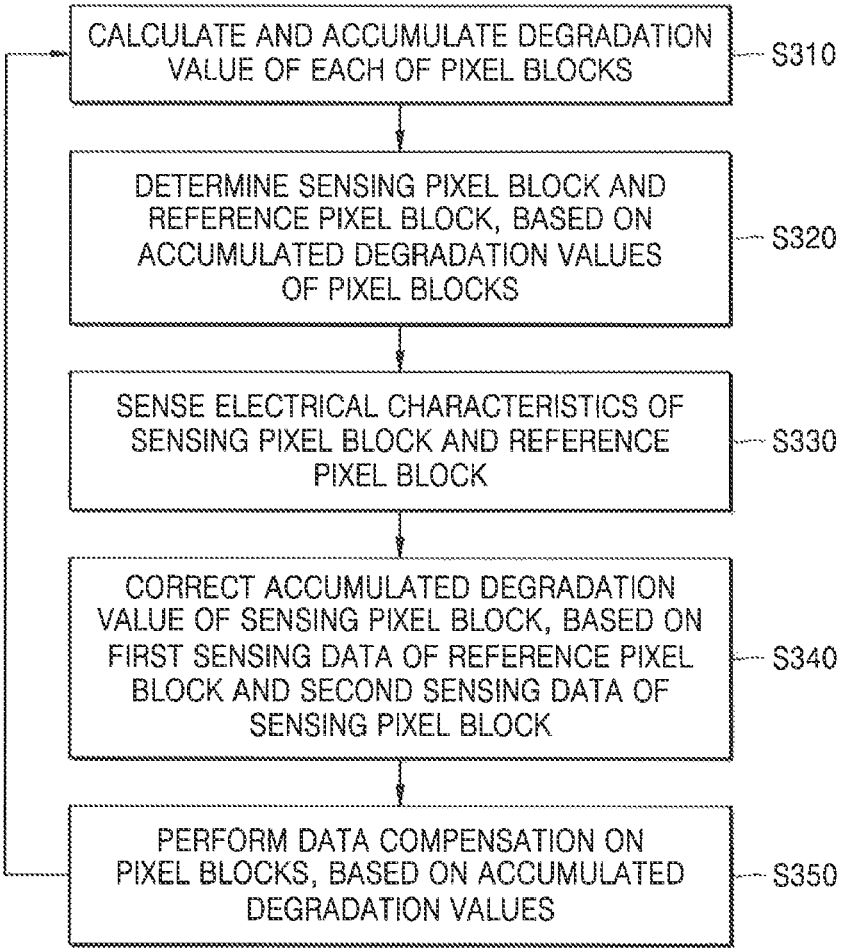
FIG. 16 is a flowchart of a data compensation method of a display device according to an exemplary embodiment of the inventive concept.

FIG. 16 is a flowchart of a data compensation method of a display device according to an exemplary embodiment of the inventive concept.

Referring to FIGS. 2 and 16, the accumulator 212 may calculate and accumulate degradation values of a plurality of pixel blocks (S310). For example, the accumulator 212 may calculate and accumulate degradation values of each of the plurality of pixel blocks. As the calculated degradation values are accumulated, an accumulated degradation value may be obtained, and the accumulator 212 may store the accumulated degradation value in the nonvolatile memory 213.

The sensing controller 214 may determine a sensing pixel block, the electrical characteristics of which are to be sensed, and a reference pixel block, based on a plurality of accumulated degradation values of the plurality of pixel blocks (S320). The sensing controller 214 may determine at least one pixel block having a relatively high accumulated degradation value of the plurality of pixel blocks as the sensing pixel block, and determine, as the reference pixel block, either a dummy pixel block in a non-display area of the display panel 20 of FIG. 1 or a pixel block which has a reference degradation rate less than a reference value. For example, the pixel block with a reference degradation rate may be determined to have no degradation. The sensing block 120 of FIG. 1 may sense (e.g., measure) electrical characteristics of the sensing pixel block and the reference pixel block, under control of the sensing controller 214 (S330). As described above, the sensing block 120 may sense at least one of various electrical characteristics. The sensing block 120 may provide the corrector 215 with sensing data indicating the sensed electrical characteristics.

The corrector 215 may correct an accumulated degradation value of the sensing pixel block, based on first sensing data of the reference pixel block and second sensing data of the sensing pixel block (S340). The corrector 215 may calculate a degradation rate, e.g., a sensing degradation value, by comparing the second sensing data of the sensing pixel block with the first sensing data indicating a state in which no gradation occurs, to compensate common variation factors, such as noise caused by an operation of the display panel 20, temperature, etc., and increase the accuracy of the compensation. The corrector 215 may convert a sensing degradation value into a degradation value by using a degradation model, and correct an accumulated degradation value of the sensing pixel block, based on a sensing degradation value SDV.

The data compensator 211 may perform data compensation on the plurality of pixel blocks, based on a plurality of accumulated degradation values (S350). In this case, the accumulated degradation value of the sensing pixel block may be a corrected accumulated degradation value.

After data compensation is performed, operations S310 to S350 may be repeatedly performed based on input data continuously received.

Figure 17:
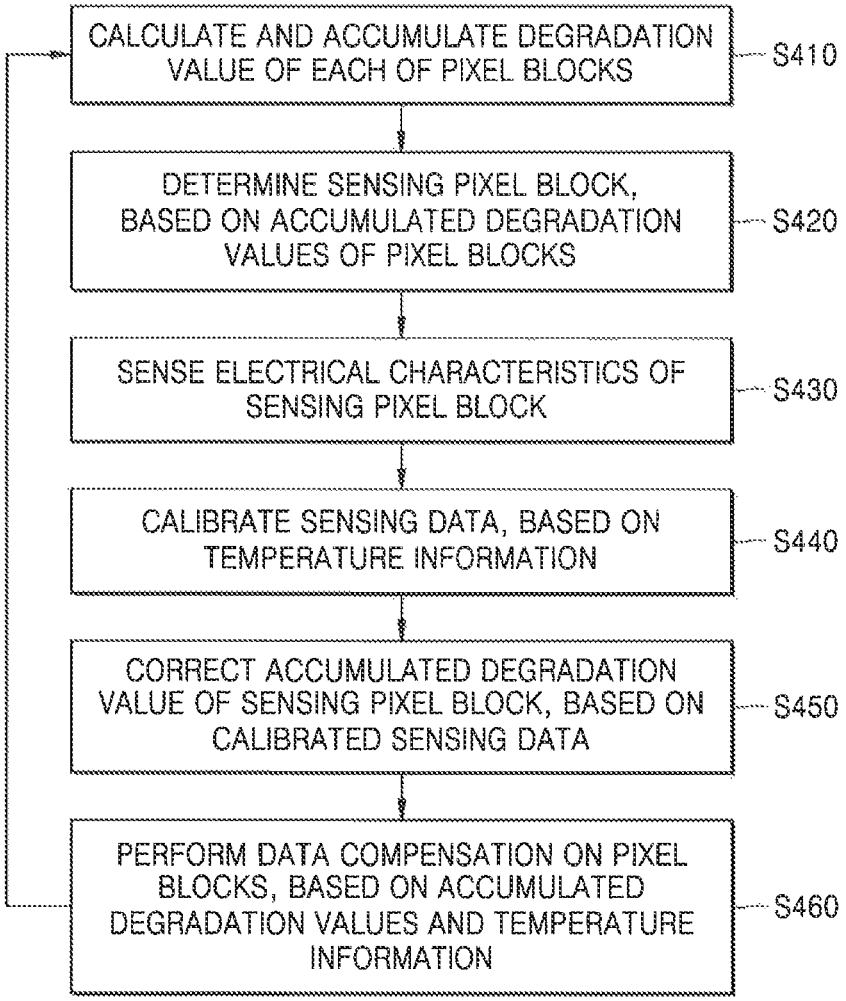
FIG. 17 is a flowchart of a data compensation method of a display device according to another exemplary embodiment of the inventive concept.

FIG. 17 is a flowchart of a data compensation method of a display device according to another exemplary embodiment of the inventive concept.

Operations S410 to S430 are substantially the same as operations S110 to S130 of FIG. 4 and thus a description thereof will not be provided.

Referring to FIGS. 2 and 17, the corrector 215 may receive sensing data from the sensing block 120 of the data driver 100 of FIG. 1, and calibrate the sensing data to correspond to a reference temperature (S440). The corrector 215 may receive a temperature of a sensing pixel block or temperature information for estimating the temperature of the sensing pixel block from the sensing block 120 or the display panel 20, and calibrate the sensing data to correspond to the reference temperature to eliminate and/or reduce influences caused by temperature when sensing is performed, when the temperature of the sensing pixel block is different from a reference temperature. The corrector 215 may correct the accumulated degradation value of the sensing pixel block, based on the calibrated sensing data (S450).

The data compensator 211 may perform data compensation on the plurality of pixel blocks, based on the plurality of accumulated degradation values and the temperature information (S460). The data compensator 211 may determine a compensation rate, based on the degradation rate, and compensate input data, based on the compensation rate as described above with reference to FIG. 9. In this case, temperature compensation may be performed based on the temperature information such that a desired luminance at the reference temperature may be output at a current temperature.

Figure 18:
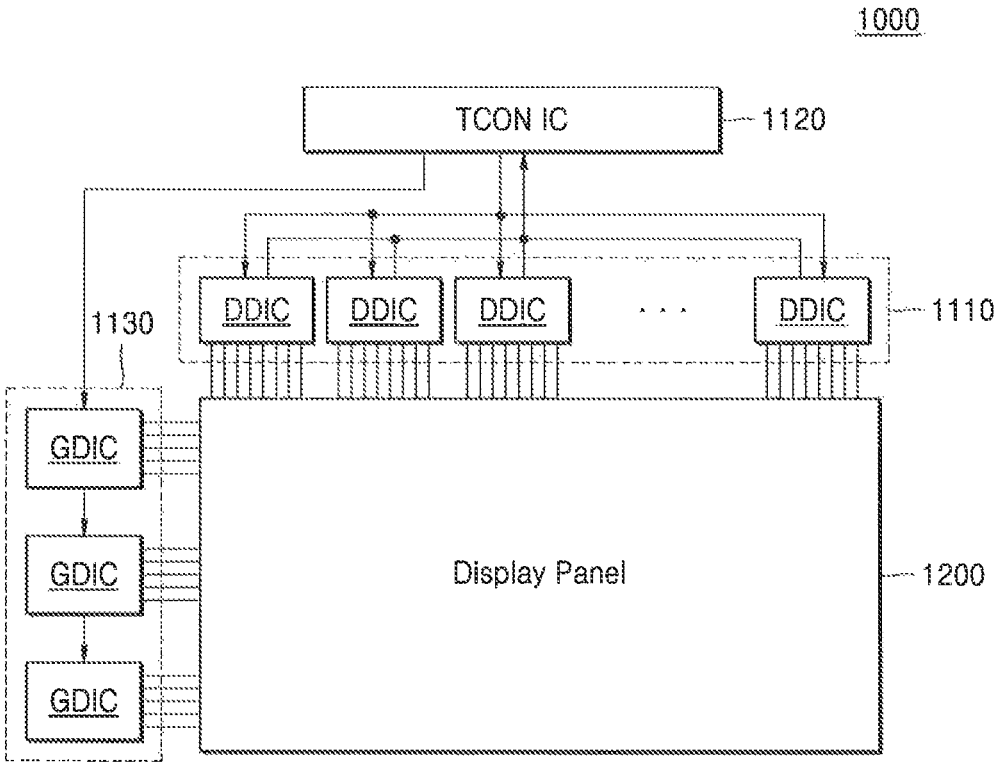
FIG. 18 illustrates a display device according to an exemplary embodiment of the inventive concept.

FIG. 18 illustrates a display device 1000 according to an exemplary embodiment of the inventive concept. The display device 1000 of FIG. 18 is a device with a middle-or-large-scale display panel 1200 and is applicable, for example, to a television, a monitor, etc.

Referring to FIG. 18, the display device 1000 may include a data driver 1110, a timing controller 1120, a gate driver 1130, and the display panel 1200.

The timing controller 1120 may include one or more integrated circuits (ICs) or modules. The timing controller 1120 may communicate with a plurality of data driving ICs (DDICs) and a plurality of gate driving ICs (GDICs) according to a set interface.

The timing controller 1120 may generate control signals for controlling driving timings of the plurality of DDICs and the plurality of GDICs, and provide the control signals to the plurality of DDICs and the plurality of GDICs.

The timing controller 1120 may divide image data received from the outside into pieces of image data, and provide each of the pieces of image data to one of the plurality of DDICs. In addition, the timing controller 1120 may perform data compensation on the received image data to compensate for pixel degradation. The timing controller 1120 may perform data compensation based on the degradation model method using an accumulated degradation value as described above with reference to FIGS. 1 to 17, and may correct the accumulated degradation value, based on the characteristic sensing method. Therefore, a consistency rate between the accumulated degradation value and an actual deterioration rate may be increased to improve luminance uniformity and reliability of the display panel 20.

The data driver 1110 includes a plurality of DDICs. The plurality of DDICs may be mounted on a circuit film, such as a TCP, a COF, art FPC or the like, and then be attached to the display panel 1200 by the TAB method or mounted on a non-display area of the display panel 1200 by the COG method.

At least one of the plurality of DDICs may include the sensing block 120 described above with reference to FIG. 1. The sensing block 120 may sense electrical characteristics of pixels and provide sensing data to the timing controller 1120.

The gate driver 1130 includes a plurality of GDICs. The plurality of GDICs may be mounted on a circuit film, and attached to the display panel 1200 by the TAB method or mounted on the non-display area of the display panel 1200 by the COG method. Alternatively, the gate driver 1130 may be formed directly on a lower substrate of the display panel 1200 by a gate-driver in panel (GIP) method. The gate driver 1130 is formed in the non-display area outside a pixel array of the display panel 1200 in which pixels PX are formed, and may be formed by the same TFT process as the pixels PX.

Figure 19:
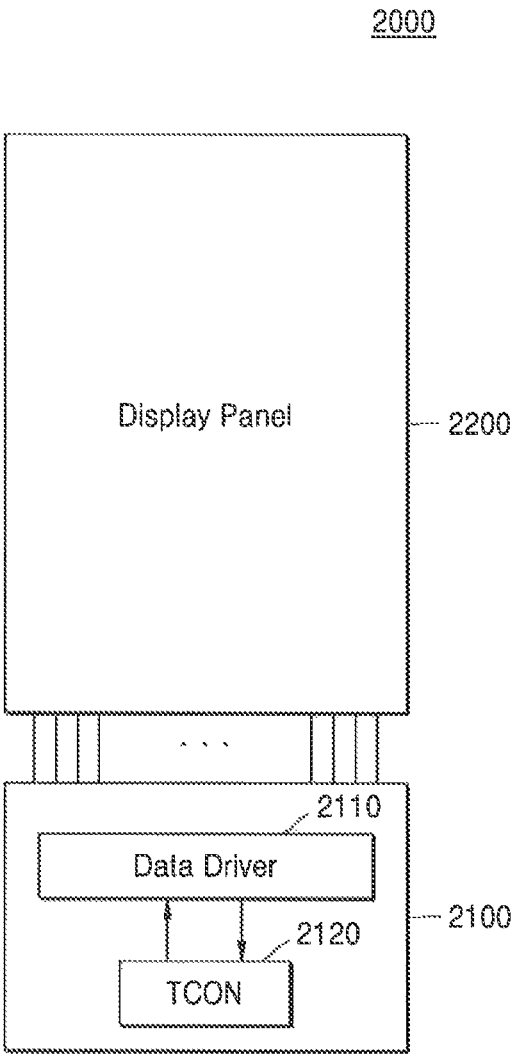
FIG. 19 illustrates a display device according to another exemplary embodiment of the inventive concept.

FIG. 19 illustrates a display device 2000 according to another exemplary embodiment of the inventive concept. The display device 2000 of FIG. 19 is a device with a small-scale display panel 2200 and is applicable to a mobile device such as a smart phone, a tablet PC, and the like.

Referring to FIG. 19, the display device 2000 may include a display driving circuit 2100 and the display panel 2200. The display driving circuit 2100 may include one or more ICs, and may, be mounted on a circuit film, such as a TCP, a COF, an FPC or the like, and attached to the display panel 2200 by the TAB method or mounted on the non-display area of the display panel 2200 by the COG method.

The display driving circuit 2100 may include a data driver 2110 and a timing controller 2120 (also referred to as a control logic), and may further include a gate driver. In an exemplary embodiment of the inventive concept, the gate driver may be mounted on the display panel 2200.

The timing controller 2120 may perform data compensation on image data received from an external device, e.g., an application processor, to compensate for pixel degradation. The timing controller 2120 may perform data compensation based on the degradation model method using an accumulated degradation value as described above with reference to FIGS. 1 to 17, and may correct the accumulated degradation value, based on the characteristic sensing method. Therefore, a consistency rate between the accumulated degradation value and an actual deterioration rate may be increased to improve luminance uniformity and reliability of the display panel 2200.

In the sensing mode, the data driver 2110 may measure electrical characteristics of pixels of the display panel 2200, and provide the timing controller 2120 with sensing data indicating the measured electrical characteristics of the pixels. The timing controller 2120 may correct the accumulated degradation value, based on the measured electrical characteristics of the pixels. The timing controller 2120 may compensate input data, based on the accumulated degradation value, and provide the compensated data to the data driver 2110. The data driver 2110 may drive the display panel 2200, based on the compensated data.

While the inventive concept has been particularly shown and described with reference to exemplary embodiments thereof, it will be understood that various changes in form and details may be made thereto without departing from the spirit and scope of the inventive concept as set forth in the following claims.

What is claimed is:

1. A display device, comprising:

a display panel including a plurality of pixels divided into a plurality of pixel blocks;

a data driver configured to supply a driving signal to each of the plurality of pixels and sense electrical characteristics of each of the plurality of pixels; and a degradation compensation circuit configured to compensate input data corresponding to each of the plurality of pixels, based on a compensation rate of the pixels corresponding to the input data, and provide the compensated input data to the data driver, wherein the degradation compensation circuit is further configured to generate and accumulate a degradation value for each of the plurality of pixels, based on driving data corresponding to the driving signal supplied to each of the plurality of pixels, calculate a compensation rate for each of the plurality of pixels by using each pixel's accumulated degradation value and a degradation model, and correct the accumulated degradation value for each of the plurality of pixels, based on the sensed electrical characteristics, wherein the degradation compensation circuit is further configured to generate a plurality of accumulated degradation values corresponding to the plurality of pixel blocks, identify a pixel block having a highest accumulated degradation value of the plurality of pixel blocks as a sensing pixel block, control the data driver to sense the sensing pixel block, perform data compensation on the sensing pixel block using the corrected accumulated degradation value associated with the highest accumulated degradation value and perform data compensation on the remainder of the pixel blocks using their associated accumulated degradation values.

2. The display device of claim 1, wherein the degradation compensation circuit is further configured to adjust a sensing cycle, based on a temperature or the highest accumulated degradation value.

3. The display device of claim 1, wherein after correcting the accumulated degradation value of the sensing pixel block, the degradation compensation circuit is further configured to add a degradation value calculated for the sensing pixel block for a next unit time to the corrected accumulated degradation value.

4. The display device of claim 1, wherein the degradation compensation circuit is further configured to convert each of the accumulated degradation values into a degradation rate, by using the degradation model, and compensate input data for each of the plurality of pixels, based on the degradation rate, wherein the degradation rate of each pixel represents a ratio of a current luminance of the pixel to its initial luminance.

5. The display device of claim 1, wherein the degradation compensation circuit comprises:

an accumulator configured to calculate and accumulate the plurality of accumulated degradation values corresponding to the plurality of pixel blocks and store the plurality of accumulated degradation values in a non-volatile memory;

a data compensator configured to convert the plurality of accumulated degradation values into degradation rates, based on the degradation model, and determine a luminance compensation rate for each of the plurality of pixel blocks, based on a plurality of degradation rates corresponding to the plurality of pixel blocks;

a sensing controller configured to select the sensing pixel block among the plurality of pixel blocks, based on the plurality of accumulated degradation values, and control the data driver to sense electrical characteristics of the sensing pixel block according to a sensing cycle; and a corrector configured to correct the accumulated degradation value corresponding to the sensing pixel block, based on the sensing data.

6. The display device of claim 5, wherein the sensing controller selects a reference pixel block among the plurality of pixel blocks, based on the plurality of accumulated degradation values, and controls the data driver to sense electrical characteristics of the reference pixel block and the sensing pixel block, and the corrector is further configured to calculate a sensing degradation rate corresponding to the sensing pixel block by comparing first sensing data corresponding to the reference pixel block to second sensing data corresponding to the sensing pixel block, and correct the accumulated degradation value corresponding to the sensing pixel block, based on the sensing degradation rate.

7. The display device of claim 6, wherein the reference pixel block comprises either a dummy pixel block in a non-display area of the display panel or a pixel block having a lowest accumulated degradation value among the plurality of accumulated degradation values.

8. The display device of claim 5, wherein the corrector is further configured to calibrate the sensing data to correspond to a reference temperature, based on temperature sensing information regarding the sensing pixel block, and correct the accumulated degradation value corresponding to the sensing pixel block, based on the calibrated sensing data.

9. The display device of claim 5, wherein the data compensator is further configured to determine a luminance compensation rate of each of the plurality of pixel blocks by comparing a reference degradation rate representing a maximum luminance decrease or a minimum luminance decrease among the plurality of degradation rates with the remaining degradation rates among the plurality of degradation rates.

10. The display device of claim 5, wherein the accumulator is further configured to generate the driving data corresponding to the driving signals by applying luminance or gamma characteristics, which are set for compensated input data with respect to each of the plurality of pixel blocks, and generate and accumulate the degradation value for each frame or at predetermined time intervals, based on the driving data.

11. The display device of claim 5, wherein the accumulator is further configured to generate and accumulate gradation data of each of the plurality of pixel blocks for each frame or at predetermined time intervals, based on compensated input data.

12. The display device of claim 1, wherein the sensing data comprises a threshold voltage of a driving transistor of a pixel to be sensed, a difference between electric potentials at first and second ends of a light-emitting element of the pixel, or a current flowing through the light-emitting element.

13. The display device of claim 1, wherein each of the plurality of pixels comprises an organic light-emitting element.

14. An operation method of a display driving circuit for driving a display panel with a plurality of pixel blocks, the operation method comprising:

generating a plurality of accumulated degradation values by calculating and accumulating a degradation value of each of the plurality of pixel blocks, based on driving data supplied to each of the plurality of pixel blocks, wherein each of the plurality of pixel blocks includes at least one pixel;

determining at least one pixel block as a sensing pixel block wherein the sensing pixel block has a high accumulated degradation value among the plurality of accumulated degradation values;

sensing electrical characteristics of the sensing pixel block;

correcting the accumulated degradation value corresponding to the sensing pixel block to match a degradation rate, based on sensing data;

performing degradation compensation on the sensing pixel block based on the corrected accumulation degradation value; and performing degradation compensation on the remainder of the pixel blocks, based on their accumulated degradation values.

15. The operation method of claim 14, wherein the correcting of the accumulated degradation value corresponding to the sensing pixel block comprises calibrating the sensing data to match a reference temperature, based on temperature information.

16. The operation method of claim 15, further comprising adjusting a sensing cycle of sensing the electrical characteristics, based on the plurality of accumulated degradation values or the temperature information.

17. The operation method of claim 14, further comprising, adding a degradation value calculated for the sensing pixel block for a next unit time to the corrected accumulated degradation value after correcting the accumulated degradation value corresponding to the sensing pixel block.

18. The operation method of claim 14, wherein the performing degradation compensation on the sensing pixel block comprises:

converting each of the corrected accumulated degradation values into a degradation rate, by using a degradation model, and compensate input data for the sensing pixel block, based on the degradation rate, wherein the degradation rate of each pixel represents a ratio of a current luminance of the pixel to its initial luminance.

19. The operation method of claim 18, wherein the generating a plurality of accumulated degradation values comprises:

generating the driving data corresponding to driving signals by applying luminance or gamma characteristics, which are set for input data with respect to each of the plurality of pixel blocks; and generating and accumulating the degradation value for each frame or at predetermined time intervals, based on the driving data.

* * * * *